US010636602B2

(12) United States Patent
Iwamoto et al.

(10) Patent No.: US 10,636,602 B2
(45) Date of Patent: Apr. 28, 2020

(54) ELECTROMAGNETIC RELAY

(71) Applicants: FUJITSU COMPONENT LIMITED, Tokyo (JP); NATIONAL UNIVERSITY CORPORATION SHIZUOKA UNIVERSITY, Shizuoka (JP)

(72) Inventors: Daiei Iwamoto, Tokyo (JP); Junya Sekikawa, Shizuoka (JP)

(73) Assignees: FUJITSU COMPONENT LIMITED, Tokyo (JP); NATIONAL UNIVERSITY CORPORATION SHIZUOKA UNIVERSITY, Shizuoka (JP)

( * ) Notice: Subject to any disclaimer, the term of this patent is extended or adjusted under 35 U.S.C. 154(b) by 86 days.

(21) Appl. No.: 15/846,399

(22) Filed: Dec. 19, 2017

(65) Prior Publication Data

US 2018/0182584 A1 Jun. 28, 2018

(30) Foreign Application Priority Data

Dec. 27, 2016 (JP) ..... 2016-252656

(51) Int. Cl.
*H01H 9/30* (2006.01)
*H01H 50/38* (2006.01)
(Continued)

(52) U.S. Cl.
CPC ..... *H01H 50/38* (2013.01); *H01H 9/34* (2013.01); *H01H 9/36* (2013.01); *H01H 9/443* (2013.01);
(Continued)

(58) Field of Classification Search
CPC ..... H01H 50/14; H01H 50/18; H01H 50/38; H01H 50/58; H01H 50/64; H01H 51/22;
(Continued)

(56) References Cited

U.S. PATENT DOCUMENTS 4,367,448 A * 1/1983 Nishizako ..... H01H 9/443 218/26
5,109,146 A * 4/1992 Maenishi ..... H01H 9/443 218/26
(Continued)

FOREIGN PATENT DOCUMENTS

CN 105304414 2/2016
EP 3012849 4/2016
(Continued)

OTHER PUBLICATIONS

Takuya Hara et al., 'Influence of Contact Material Vapor on Thermodynamic and Transport Properties of Arc Plasmas Occurring between Ag and Ag/SnO2 contact pairs', IEICE Transactions on Electronics vol. E97-C No. 9 pp. 863-866, Sep. 1, 2014.

*Primary Examiner* — Shawki S Ismail
*Assistant Examiner* — Lisa N Homza
(74) *Attorney, Agent, or Firm* — IPUSA, PLLC

(57) ABSTRACT

An electromagnetic relay includes a fixed contact part including a fixed terminal and a fixed contact connected to the fixed terminal, a movable contact part including a movable contact spring and a movable contact connected to the movable contact spring, an armature to which the movable contact part is connected, an electromagnet configured to move the armature, a magnet configured to stretch an arc generated between the fixed contact and the movable contact, and a first arc extinguishing plate and a second arc extinguishing plate configured to extinguish the stretched arc. The fixed contact and the movable contact are disposed between the first arc extinguishing plate and the second arc extinguishing plate. The magnet is disposed between a first pair of the fixed contact part and the movable contact part and a second pair of the fixed contact part and the movable contact part.

5 Claims, 24 Drawing Sheets

(51) Int. Cl.

| | |
|---|---|
| ***H01H 9/34*** | (2006.01) |
| ***H01H 50/18*** | (2006.01) |
| ***H01H 50/14*** | (2006.01) |
| ***H01H 9/44*** | (2006.01) |
| ***H01H 9/36*** | (2006.01) |
| ***H01H 33/59*** | (2006.01) |
| *H01H 50/26* | (2006.01) |
| *H01H 1/20* | (2006.01) |
| *H01H 50/54* | (2006.01) |

(52) U.S. Cl.
CPC ..... *H01H 33/596* (2013.01); *H01H 50/14* (2013.01); *H01H 50/18* (2013.01); *H01H 1/2066* (2013.01); *H01H 50/26* (2013.01); *H01H 50/546* (2013.01)

(58) Field of Classification Search
CPC .. H01H 51/2236; H01H 51/2772; H01H 9/34; H01H 2001/545
USPC ..... 335/201
See application file for complete search history.

(56) References Cited

U.S. PATENT DOCUMENTS 5,568,108 A * 10/1996 Kirsch ..... H01H 51/2227 335/130
6,489,868 B1 * 12/2002 Sato ..... H01H 50/38 335/128
6,700,466 B1 * 3/2004 Yamamoto ..... H01H 9/302 218/156
7,145,422 B2 * 12/2006 Imanishi ..... H01H 9/443 335/201
7,285,742 B2 * 10/2007 Kinzler ..... H01H 71/0207 218/149
7,477,119 B2 * 1/2009 Wu ..... H01H 50/043 335/128
8,193,881 B2 * 6/2012 Yuba ..... H01H 9/443 335/128
8,228,144 B2 * 7/2012 Sugisawa ..... H01H 1/54 335/128
8,390,410 B2 * 3/2013 Kojima ..... H01H 9/443 335/128
8,446,235 B2 * 5/2013 Iwamoto ..... H01H 50/56 335/201
8,482,368 B2 * 7/2013 Sasaki ..... H01H 9/443 335/201
9,007,156 B2 * 4/2015 Hiraiwa ..... H01H 9/443 335/78
9,064,664 B2 * 6/2015 Yamamoto ..... H01H 1/32
9,076,617 B2 * 7/2015 Yamashita ..... H01H 9/40
9,082,575 B2 * 7/2015 Yamashita ..... H01H 9/443
9,123,494 B2 * 9/2015 Shinkai ..... H01H 51/06
10,242,829 B2 * 3/2019 Hasegawa ..... H01H 50/38
2009/0134962 A1 * 5/2009 Nishida ..... H01H 9/443 335/207
2009/0322453 A1 * 12/2009 Kawaguchi ..... H01F 7/1615 335/81
2013/0075367 A1 * 3/2013 Eriksson ..... H01H 9/40 218/34
2013/0113581 A1 * 5/2013 Kakimoto ..... H01H 50/26 335/196
2016/0027602 A1 * 1/2016 Hasegawa ..... H01H 50/58 335/189
2016/0372286 A1 * 12/2016 Kubono ..... H01H 9/443
2017/0025232 A1 1/2017 Hiraki et al.

FOREIGN PATENT DOCUMENTS

| | | |
|---|---|---|
| JP | 2012-199113 | 10/2012 |
| JP | 2012-256452 | 12/2012 |
| JP | 2015-220180 | 12/2015 |

* cited by examiner

ELECTROMAGNETIC RELAY

CROSS-REFERENCE TO RELATED APPLICATION

The present application is based upon and claims the benefit of priority of Japanese Patent Application No. 2016-252656, filed on Dec. 27, 2016, the entire contents of which are incorporated herein by reference.

BACKGROUND OF THE INVENTION

1. Field of the Invention

An aspect of this disclosure relates to an electromagnetic relay.

2. Description of the Related Art

An electromagnetic relay is an electronic component that turns on and off electric power using an electromagnet. When an electromagnetic relay is used for high-voltage power or direct-current power, an arc may be generated between contacts and the arc may reduce the life of the electromagnetic relay (see, for example, Takuya HARA, Junya SEKIKAWA, "Influence of Contact Material Vapor on Thermodynamic and Transport Properties of Arc Plasmas Occurring between Ag and Ag/SnO2 contact pairs", IEICE TRANSACTIONS on Electronics Vol. E97-C No. 9 pp. 863-866, 2014/09/01).

In a known method, a permanent magnet is provided near the contacts so that an arc, which is generated when the contacts are moved apart from each other, is extinguished by a magnetic field generated by the permanent magnet and the power is shut off quickly (see, for example, Japanese Laid-Open Patent Publication No. 2012-256452, Japanese Laid-Open Patent Publication No. 2015-220180, and Japanese Laid-Open Patent Publication No. 2012-199113).

Electromagnetic relays are generally produced based on an assumption that the electric current flows in one direction. However, in electric vehicles and photovoltaic power generation systems, a large high-voltage current flows in both directions for charging and discharging. Therefore, there is a demand for an electromagnetic relay that can quickly extinguish an arc regardless of the direction in which an electric current flows.

SUMMARY OF THE INVENTION

In an aspect of this disclosure, there is provided an electromagnetic relay that includes a fixed contact part including a fixed terminal and a fixed contact connected to the fixed terminal, a movable contact part including a movable contact spring and a movable contact connected to the movable contact spring, an armature to which the movable contact part is connected, an electromagnet configured to move the armature, a magnet configured to stretch an arc generated between the fixed contact and the movable contact, and a first arc extinguishing plate and a second arc extinguishing plate configured to extinguish the stretched arc. The electromagnetic relay is configured such that the armature is moved by a magnetic field generated by the electromagnet to cause the movable contact to contact the fixed contact. The fixed contact and the movable contact are disposed between the first arc extinguishing plate and the second arc extinguishing plate. The electromagnetic relay includes a first pair of the fixed contact part and the movable contact part and a second pair of the fixed contact part and the movable contact part, and the magnet is disposed between the first pair of the fixed contact part and the movable contact part and the second pair of the fixed contact part and the movable contact part.

DESCRIPTION OF EMBODIMENTS

Embodiments of the present invention are described below. The same reference number is assigned to the same component, and repeated descriptions of the same component are omitted.

First Embodiment

Figure 1:
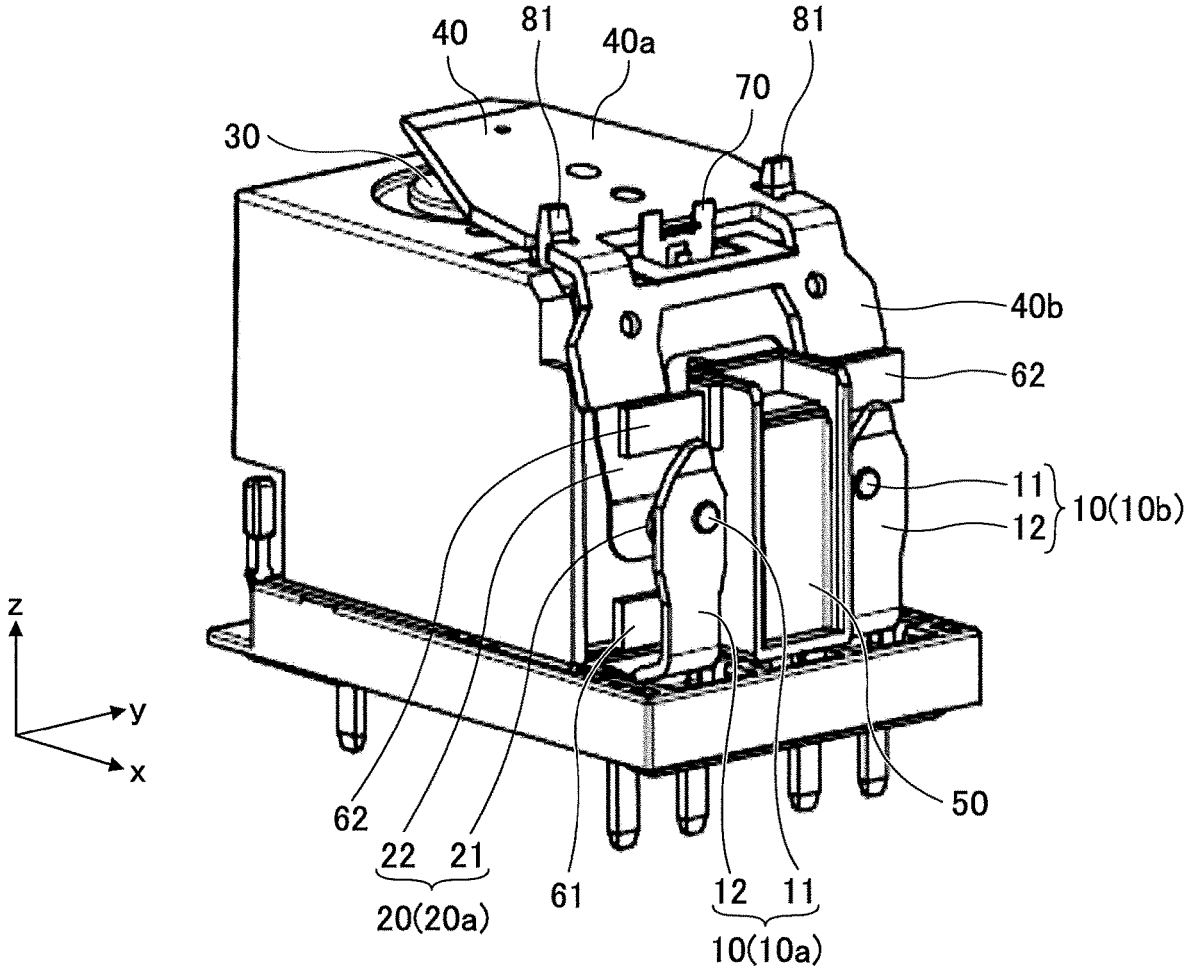
FIG. 1 is a perspective view of an electromagnetic relay according to a first embodiment.
Figure 2:
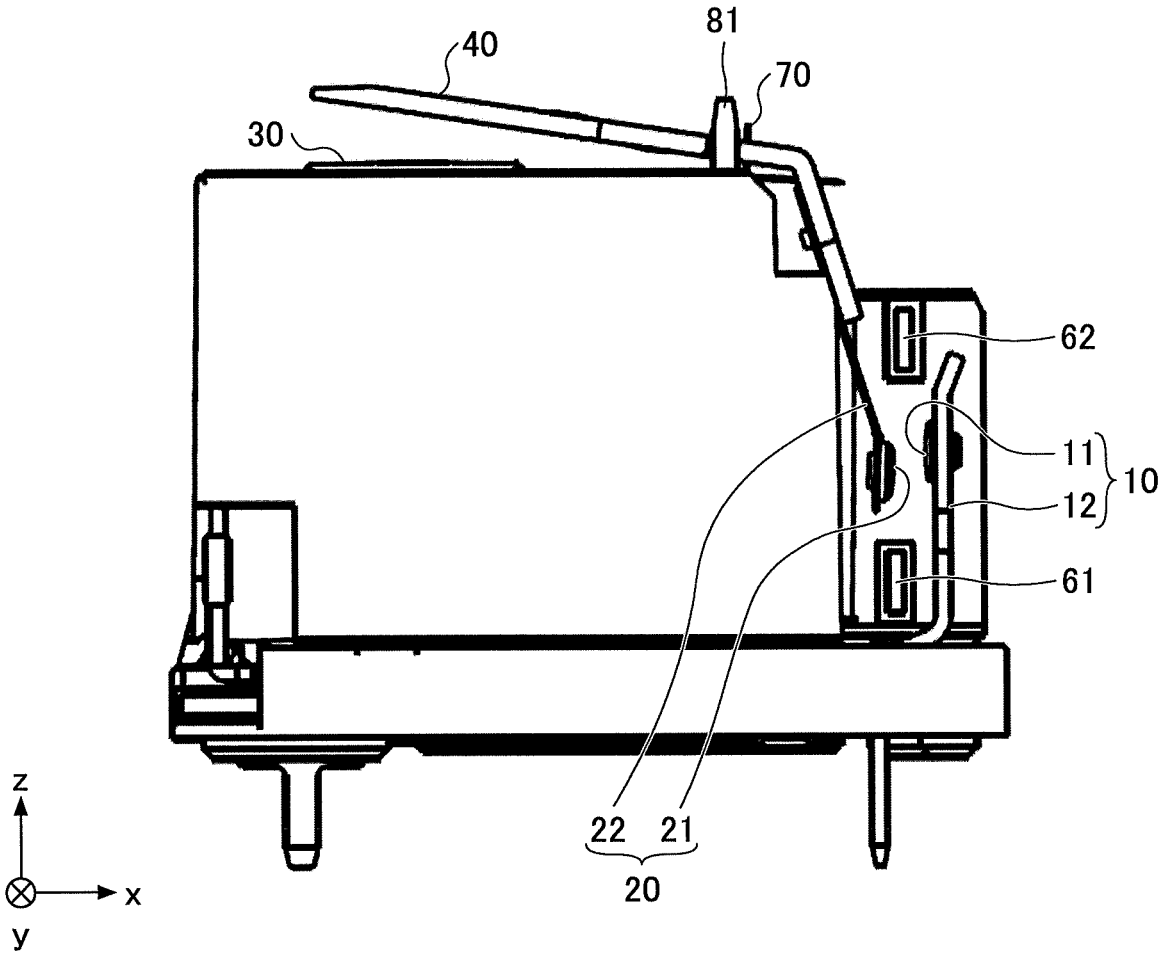
FIG. 2 is a side view of the electromagnetic relay according to the first embodiment.
Figure 3:
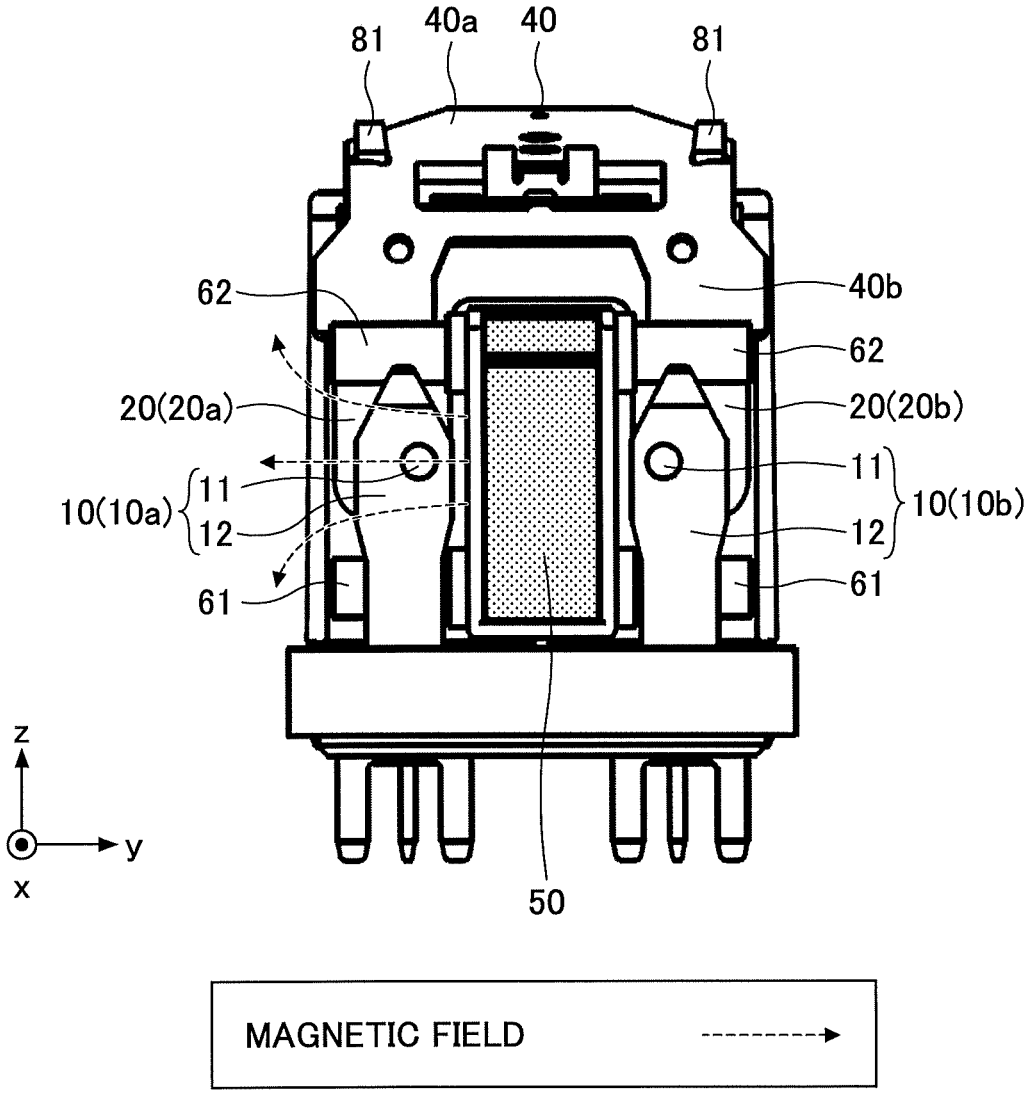
FIG. 3 is a front view of the electromagnetic relay according to the first embodiment.

An electromagnetic relay (hereinafter referred to as "relay") according to a first embodiment is described with reference to FIGS. 1 through 3. The relay of the first embodiment includes a fixed contact part 10 including a fixed contact 11 and a fixed terminal 12, and a movable contact part 20 including a movable contact 21 and a movable spring 22. In the first embodiment, the relay includes two pairs of the fixed contact part 10 and the movable contact part 20. In the descriptions below, one of the two pairs including a fixed contact part 10*a* and a movable contact part 20*a* is referred to as a first contact pair, and the other one of the two pairs including a fixed contact part 10*b* and a movable contact part 20*b* is referred to as a second contact pair.

An electromagnet 30 is provided on the side of the relay where the movable contact parts 20 are provided. An armature 40 is provided near an end of the electromagnet 30. The armature 40 is bent into a shape like an inverted V. A portion of the armature 40 near the bend is in contact with a yoke 81, and the armature 40 is rotatable around the portion that is in contact with the yoke 81. The armature 40 is divided at the bend into a first side 40*a* to be brought into contact with the electromagnet 30 and a second side 40*b* connected to the movable contact parts 20.

A permanent magnet 50 for extinguishing an arc is provided between the first contact pair and the second contact pair. The permanent magnet 50 is disposed such that the longitudinal direction of the permanent magnet 50 becomes orthogonal to a line connecting the fixed contacts 11 of both of the fixed contact part 10*a* and the fixed contact part 10*b*. As indicated by dotted arrows in FIG. 3, on the side of the first contact pair, the magnetic field of the permanent magnet 50 is oriented in a direction away from the permanent magnet 50, i.e., substantially in −y direction near the fixed contact 11 and the movable contact 21.

A first arc extinguishing plate 61 is provided below the fixed contact 11 and the movable contact 21 of the first contact pair, and a second arc extinguishing plate 62 is provided above the fixed contact 11 and the movable contact 21 of the first contact pair. More specifically, the first arc extinguishing plate 61 is disposed away from the fixed contact 11 and the movable contact 21 of the first contact pair in −z direction, and the second arc extinguishing plate 62 is disposed away from the fixed contact 11 and the movable contact 21 of the first contact pair in +z direction. Similarly, a first arc extinguishing plate 61 is provided below the fixed contact 11 and the movable contact 21 of the second contact pair, and a second arc extinguishing plate 62 is provided above the fixed contact 11 and the movable contact 21 of the second contact pair.

Thus, the fixed contact 11 and the movable contact 21 are disposed between the first arc extinguishing plate 61 and the second arc extinguishing plate 62. Also, the direction from the first contact 11 and the movable contact 21 toward the first arc extinguishing plate 61 and the direction from the first contact 11 and the movable contact 21 toward the second arc extinguishing plate 62 are substantially orthogonal to the direction of the magnetic field of the permanent magnet 50. In other words, the direction in which the fixed contact 11 and the movable contact 21, the first arc extinguishing plate 61, and the second arc extinguishing plate 62 are arranged is substantially orthogonal to the direction of the magnetic field of the permanent magnet 50. Also, the direction in which the fixed contact 11 and the movable contact 21, the first arc extinguishing plate 61, and the second arc extinguishing plate 62 are arranged, i.e., z direction, is substantially parallel to the longitudinal direction of the permanent magnet 50.

The first arc extinguishing plate 61 and the second arc extinguishing plate 62 are formed of ceramic such as alumina (aluminum oxide). The first arc extinguishing plate 61 and the second arc extinguishing plate 62 may instead be formed of a non-magnetic metal such as copper or aluminum. However, the first arc extinguishing plate 61 and the second arc extinguishing plate 62 are preferably formed of alumina, because alumina has a melting point of 2027° C. that is higher than the melting points of non-magnetic metals, and has high thermal resistance. Forming the arc extinguishing plates 61 and 62 with a material having high thermal resistance makes it possible to reduce damage such as ablation caused by an arc on the arc extinguishing plates 61 and 62.

Figure 4:
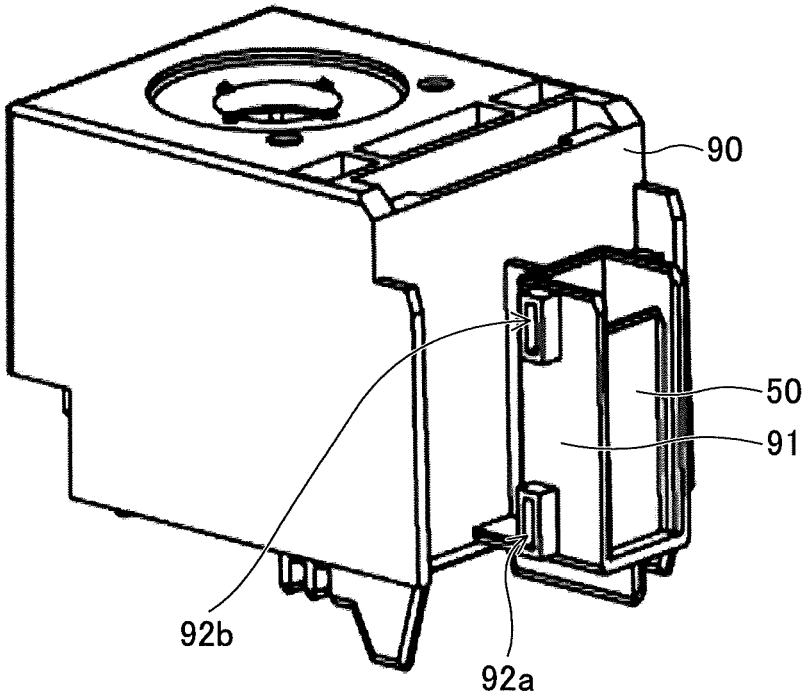
FIG. 4 is a perspective view of an insulation case of the electromagnetic relay according to the first embodiment.
Figure 5:
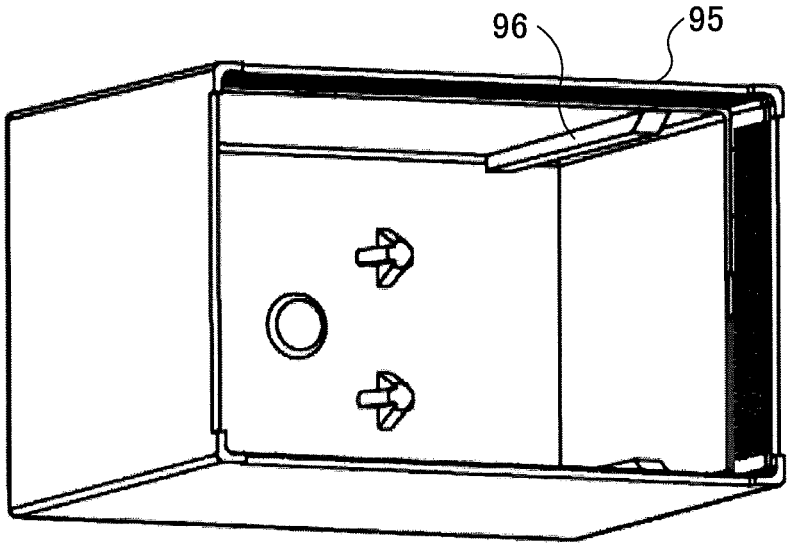
FIG. 5 is a perspective view of a cover of the electromagnetic relay according to the first embodiment.
Figure 6:
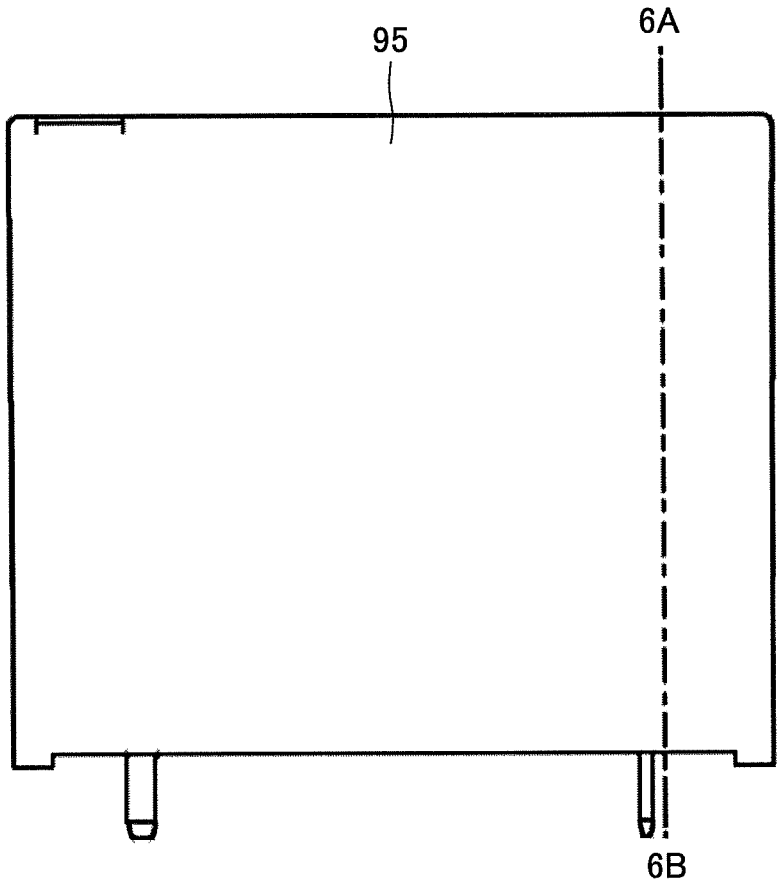
FIG. 6 is a side view of the electromagnetic relay with the cover according to the first embodiment.
Figure 7:
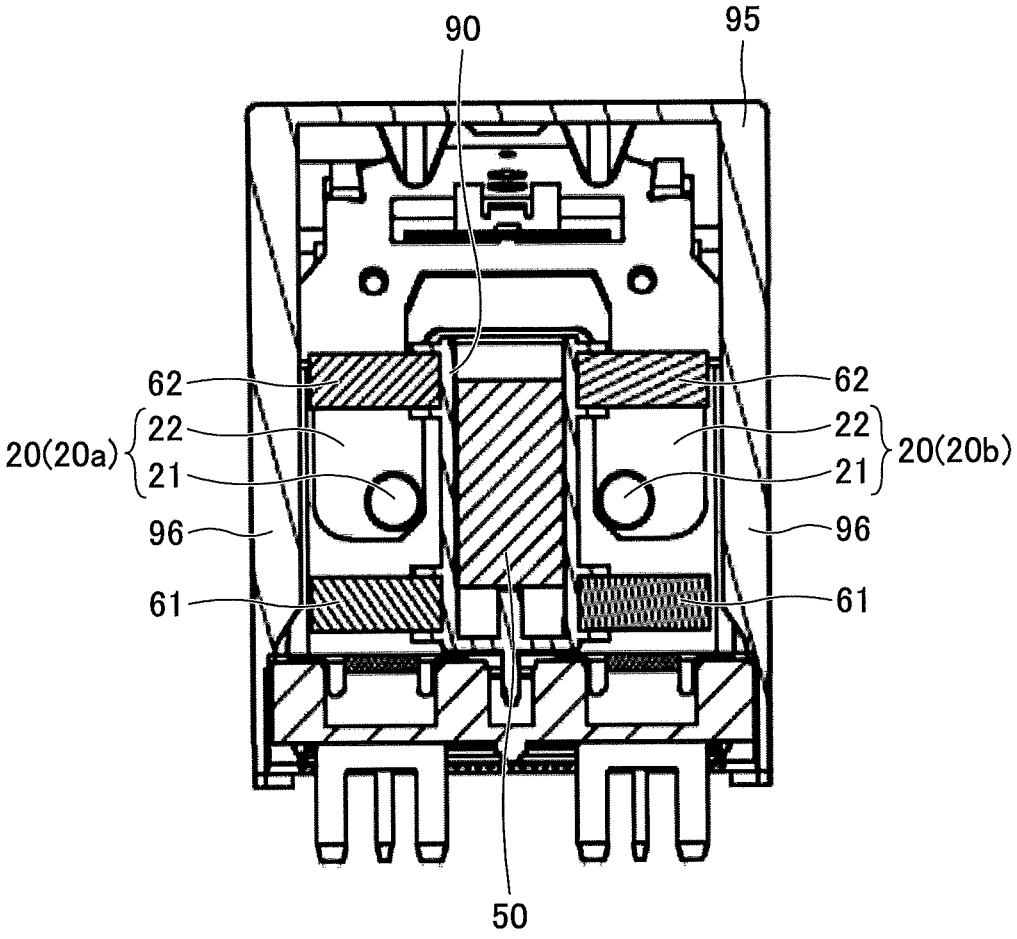
FIG. 7 is a cross-sectional view of the electromagnetic relay according to the first embodiment.

In the first embodiment, as illustrated in FIGS. 4 through 7, the first arc extinguishing plate 61 and the second arc extinguishing plate 62 are disposed between an insulation case 90 covering the electromagnet 30 and a cover 95 covering the entire relay. More specifically, the first arc extinguishing plate 61 and the second arc extinguishing plate 62 are disposed between the cover 95 and a side wall 91 of the insulation case 90 covering the permanent magnet 50. FIG. 4 is a perspective view of the insulation case 90, and FIG. 5 is a perspective view of the cover 95. FIG. 6 is a side view of the relay, and FIG. 7 is a cross-sectional view of the relay taken along a dashed-dotted line 6A-6B of FIG. 6.

A press-in socket 92*a* into which the first arc extinguishing plate 61 is inserted and a press-in socket 92*b* into which the second arc extinguishing plate 62 is inserted are formed on the outer side of the side wall 91. Also, a protrusion 96 is formed on the inner side of the cover 95 at a position corresponding to the socket 92*a* and the socket 92*b*.

The protrusion 96 is formed on the inner side of the cover 95 at a position corresponding to the first arc extinguishing plate 61 and the second arc extinguishing plate 62. The length of the end portion of the first arc extinguishing plate 61 pressed into the socket 92*a* is longer than the distance between the protrusion 96 and the other end of the first arc extinguishing plate 61. Also, the length of the end portion of the second arc extinguishing plate 62 pressed into the socket 92*b* is longer than the distance between the protrusion 96 and the other end of the second arc extinguishing plate 62. Accordingly, with the cover 95 placed over the insulation case 90, the protrusion 96 prevents the first arc extinguishing plate 61 and the second arc extinguishing plate 62 from coming out of the socket 92*a* and the socket 92*b*.

In the first embodiment, when an electric current flows through the electromagnet 30, a magnetic field is generated by the electromagnet 30, and the first side 40*a* of the armature 40, which is formed of a magnetic material such as iron, is attracted by the magnetic field and contacts the electromagnet 30. As a result, the armature 40 rotates around the portion contacting the yoke 81, the movable contact part 20 connected to the second side 40*b* of the armature 40 moves toward the fixed contact part 10, and the movable contact 21 contacts the fixed contact 11. Thus, the movable contact 21 and the fixed contact 11 are electrically connected to each other and the relay is turned on to allow an electric current to flow via the movable contact 21 and the fixed contact 11.

When the electric current flowing through the electromagnet 30 is stopped, the magnetic field generated by the electromagnet 30 disappears, and the force attracting the armature 40 disappears. Then, due to the restoring force of a spring 70, the armature 40 rotates in a direction to move the movable contact 21 away from the fixed contact 11. As a result, the movable contact 21 and the fixed contact 11 are electrically disconnected from each other, and the relay is turned off.

When the movable contact 21 moves away from the fixed contact 11, an arc is generated between the movable contact 21 and the fixed contact 11. The arc is stretched by the magnetic field of the permanent magnet 50 and contacts either the first arc extinguishing plate 61 or the second arc extinguishing plate 62, and heat is removed from the arc by the arc extinguishing plates 61 and 62. As a result, the conductivity of the arc is reduced, the arc current is decreased, and the arc is quickly extinguished. Also, a shape of the stretched arc contacting the first arc extinguishing plate 61 or the second arc extinguishing plate 62 is made into an M-shape and makes it possible to stretch the arc with a smaller space.

The fixed contact 11 is disposed on the fixed terminal 12 in a position that is closer to the permanent magnet 50 than the center of the fixed terminal 12 in the width direction, and the movable contact 21 is disposed on the movable spring 22 in a position that is closer to the permanent magnet 50 than the center of the movable contact spring 22 in the width direction. Each of the fixed terminal 12 and the movable spring 22 has a width that is necessary to conduct electricity. When the fixed contact 11 is provided in the center of the fixed terminal 12 and the movable contact 21 is provided in the center of the movable spring 22 in the width direction, the distance between the permanent magnet 50 and each of the fixed contact 11 and the movable contact 21 becomes too large to obtain a magnetic flux that is strong enough to stretch the arc. For this reason, the fixed contact 11 and the movable contact 21 are disposed in positions closer to the permanent magnet 50 to reduce the distance from the permanent magnet 50 and obtain a magnetic flux that is strong enough to stretch the arc.

Figure 8:
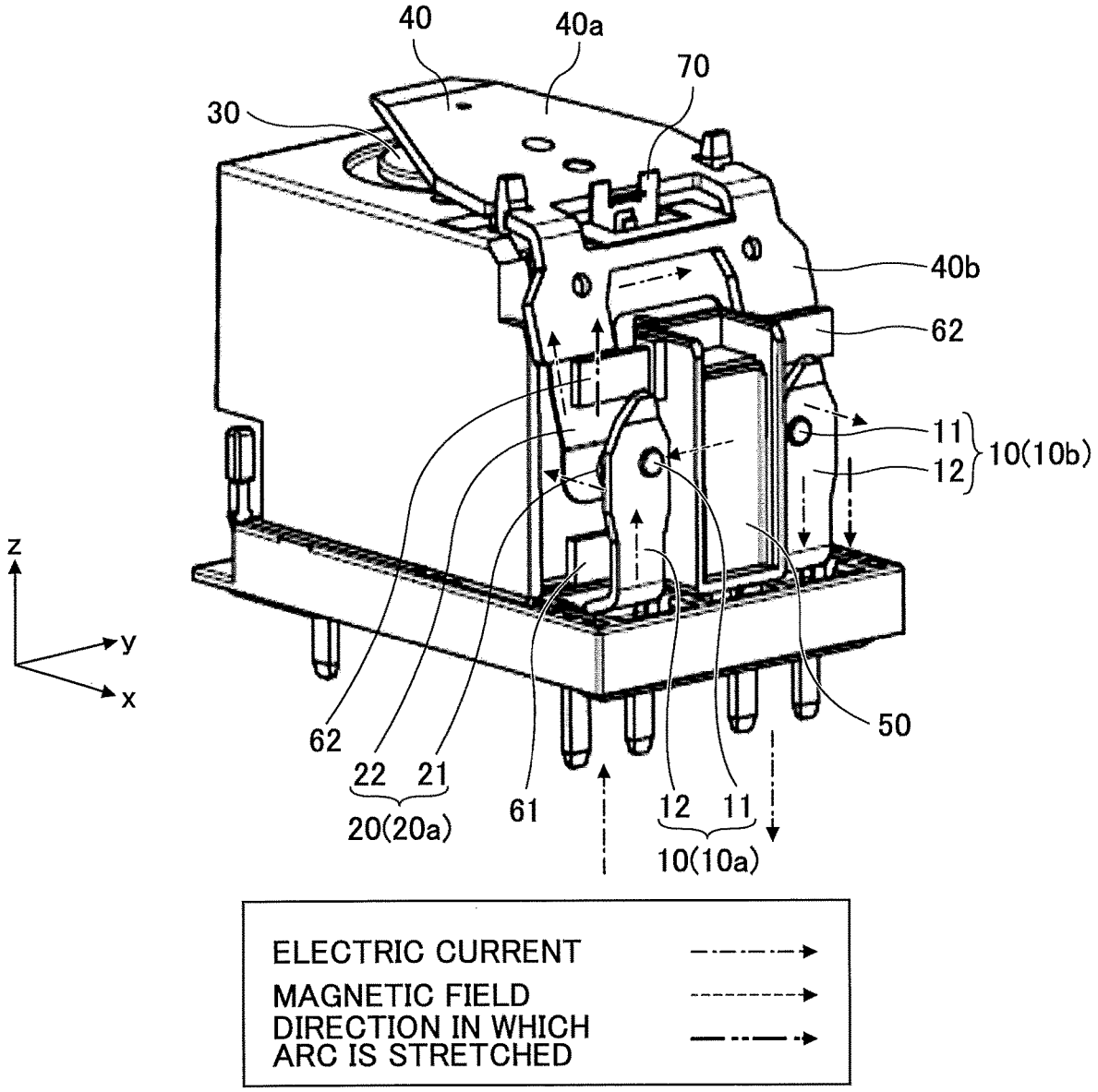
FIG. 8 is a drawing used to describe a mechanism for extinguishing an arc.
Figure 9A:
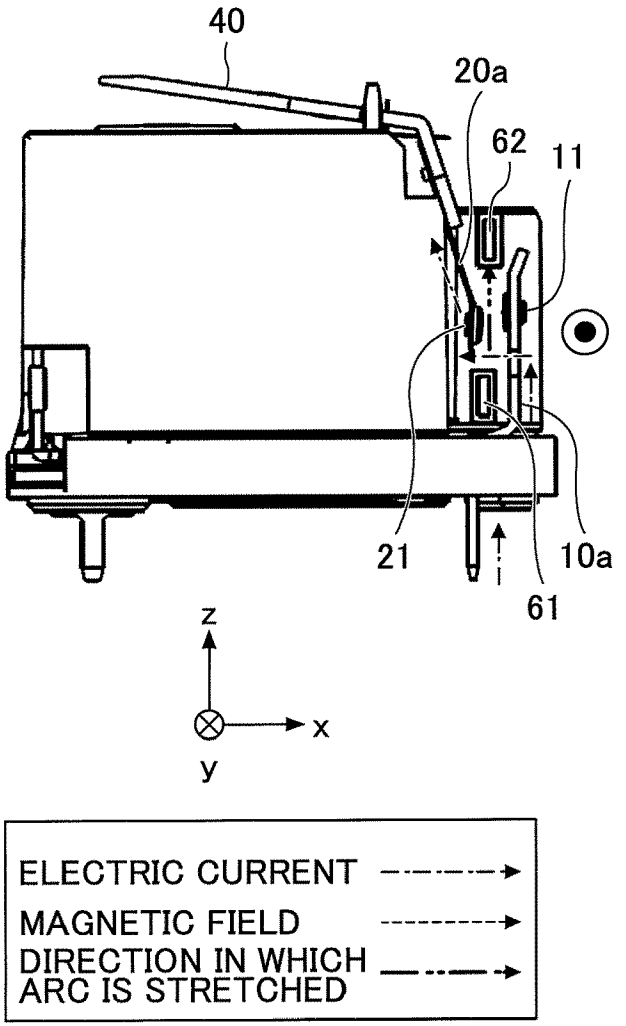
FIGS. 9A through 9C are drawings used to describe a mechanism for extinguishing an arc.
Figure 9B:
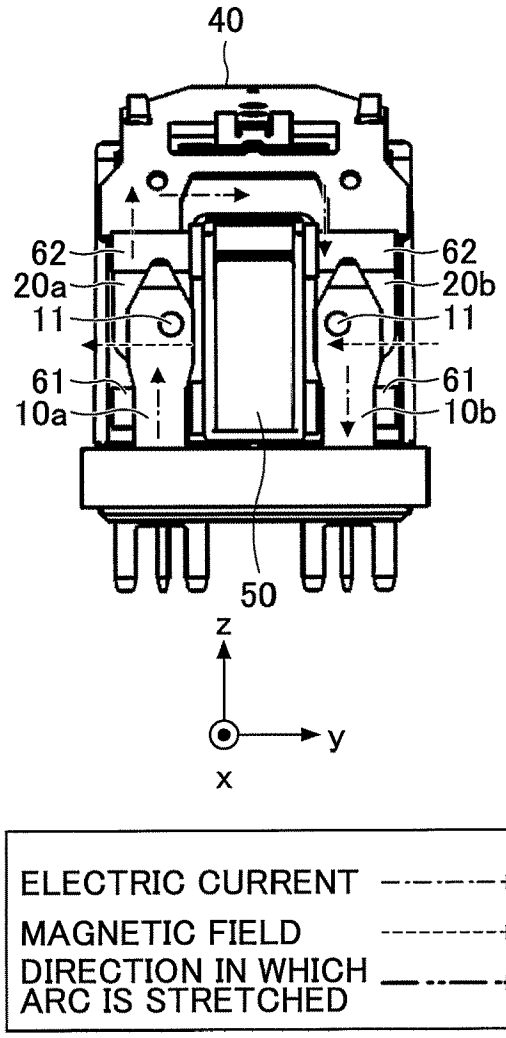
Figure 9C:
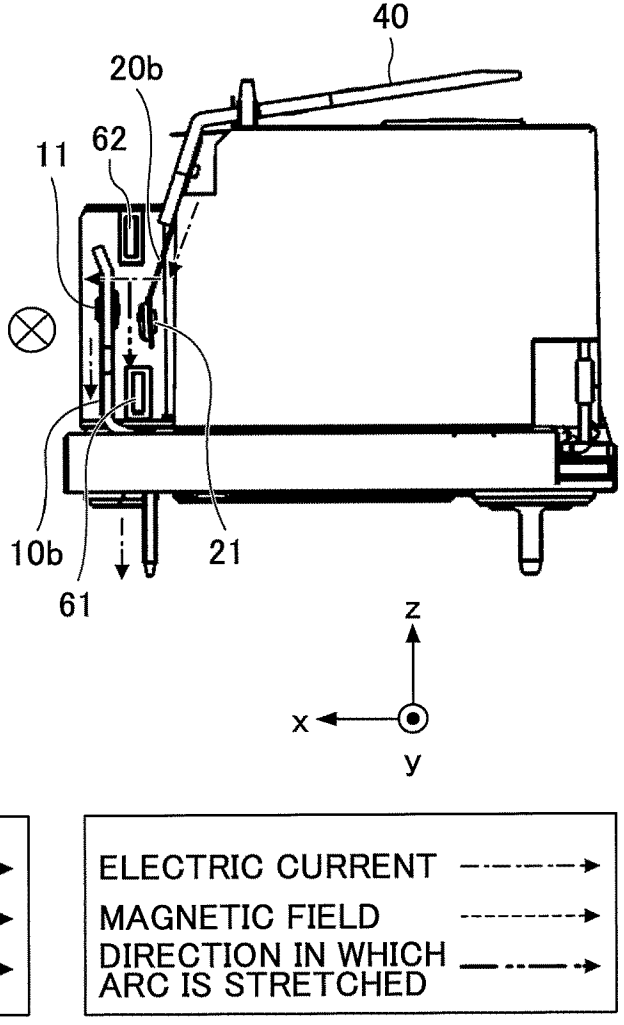

In a case where an electric current flows from the fixed contact part 10*a* to the fixed contact part 10*b*, the electric current flows as indicated by dashed-dotted arrows in FIGS. 8 through 9C. The direction in which the electric current flows through the first contact pair is opposite the direction in which the electric current flows through the second contact pair. As indicated by dotted arrows, the magnetic field of the permanent magnet 50 is oriented substantially in −y direction at a position near the fixed contacts 11 and the movable contacts 21. FIG. 8 is a perspective view, FIG. 9A is a left-side view, FIG. 9B is a front view, and FIG. 9C is a right-side view of the relay.

Figure 10B:
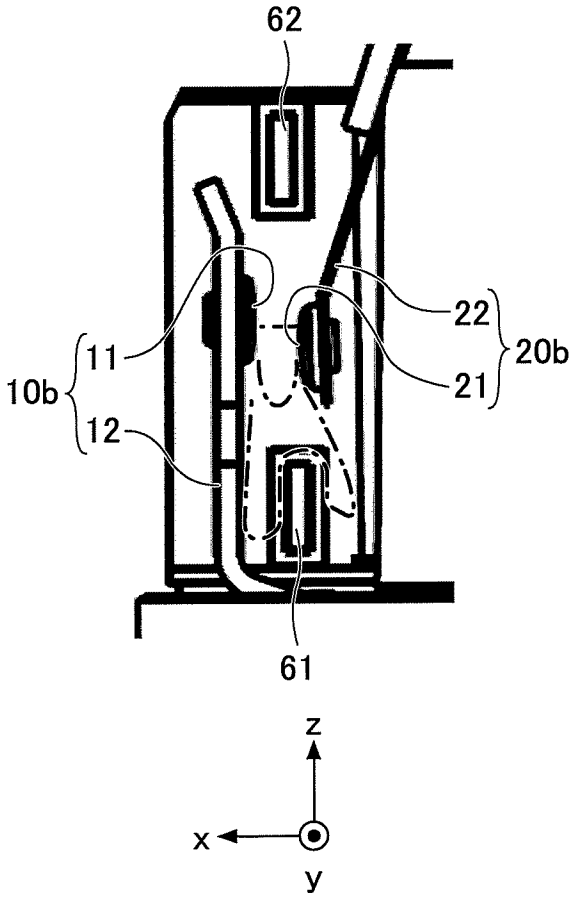
FIGS. 10A and 10B are drawings used to describe a mechanism for extinguishing an arc.
Figure 10A:
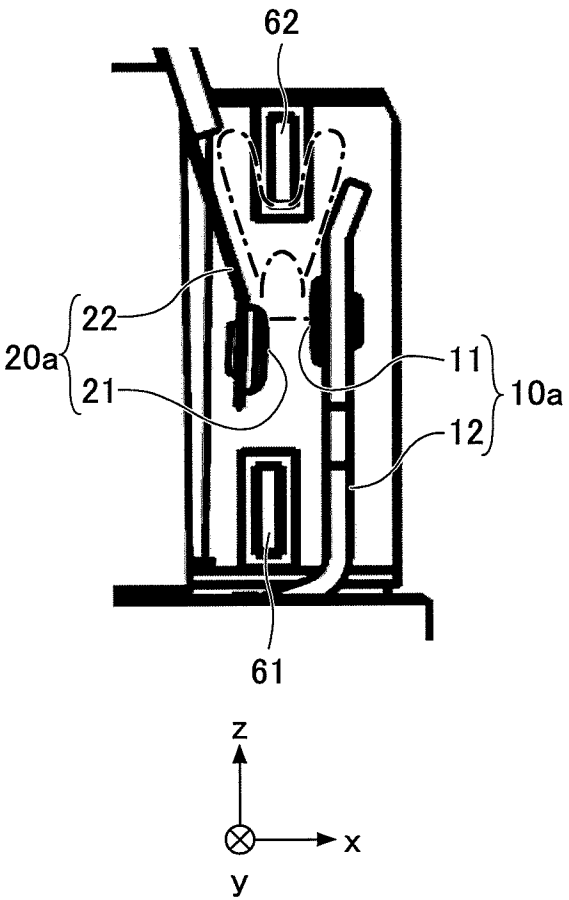

In this case, the electric current flows through the first contact pair in a direction from the fixed contact 11 toward the movable contact 21 as illustrated in FIG. 9A. Accordingly, an arc generated when the movable contact 21 moves away from the fixed contact 11 is stretched in +z direction indicated by a dashed double-dotted arrow. As illustrated in FIG. 10A, the stretched arc contacts the second arc extinguishing plate 62 disposed away from the fixed contact 11 and the movable contact 21 in +z direction, heat is removed from the arc by the second arc extinguishing plate 62, and the arc is quickly extinguished.

Also, as illustrated in FIG. 9C, the electric current flows through the second contact pair in a direction from the movable contact 21 toward the fixed contact 11. Accordingly, an arc generated when the movable contact 21 moves away from the fixed contact 11 is stretched in −z direction. As illustrated in FIG. 10B, the stretched arc contacts the first arc extinguishing plate 61 disposed away from the fixed contact 11 and the movable contact 21 in −z direction, heat is removed from the arc by the first arc extinguishing plate 61, and the arc is quickly extinguished.

Thus, in the case where the electric current flows from the fixed contact part 10*a* to the fixed contact part 10*b*, an arc generated in the first contact pair and stretched by the permanent magnet 50 contacts and is extinguished by the second arc extinguishing plate 62, and an arc generated in the second contact pair and stretched by the permanent magnet 50 contacts and is extinguished by the first arc extinguishing plate 61.

Figure 11:
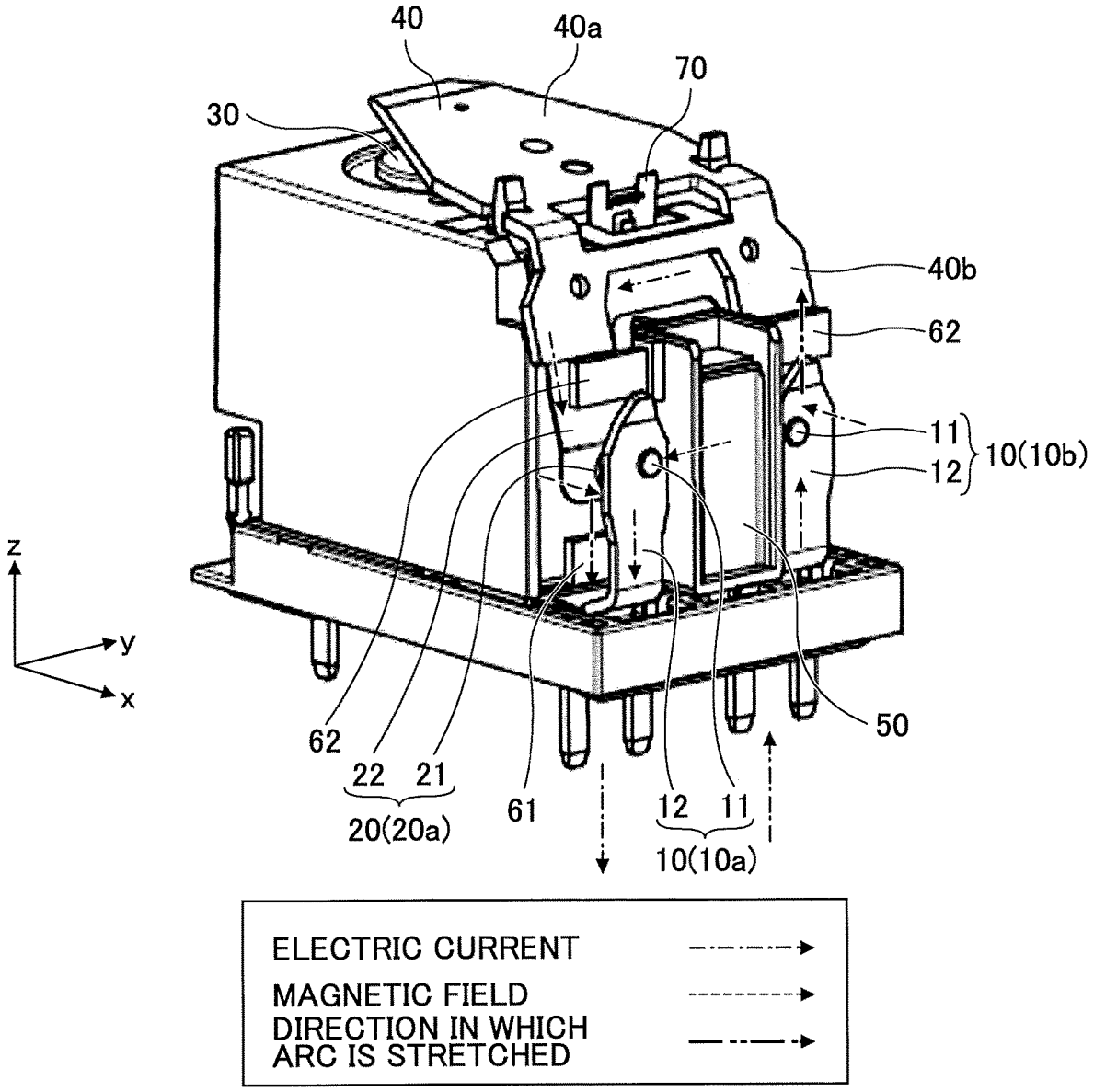
FIG. 11 is a drawing used to describe a mechanism for extinguishing an arc.
Figure 12A:
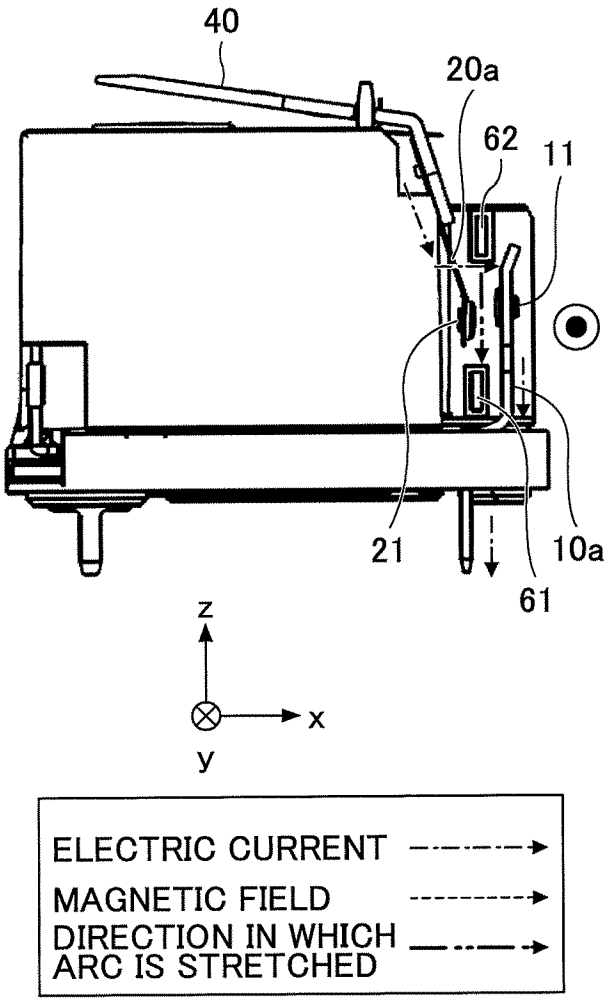
FIGS. 12A through 12C are drawings used to describe a mechanism for extinguishing an arc.
Figure 12B:
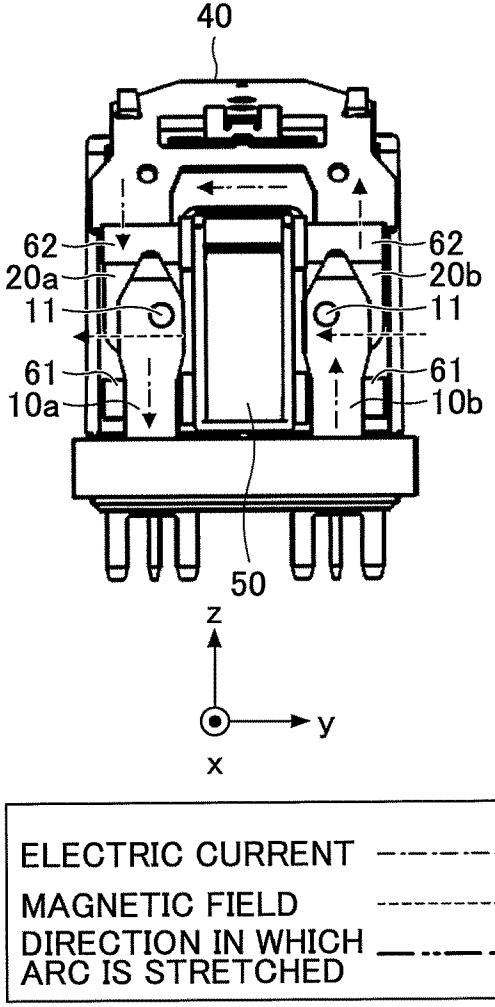
Figure 12C:
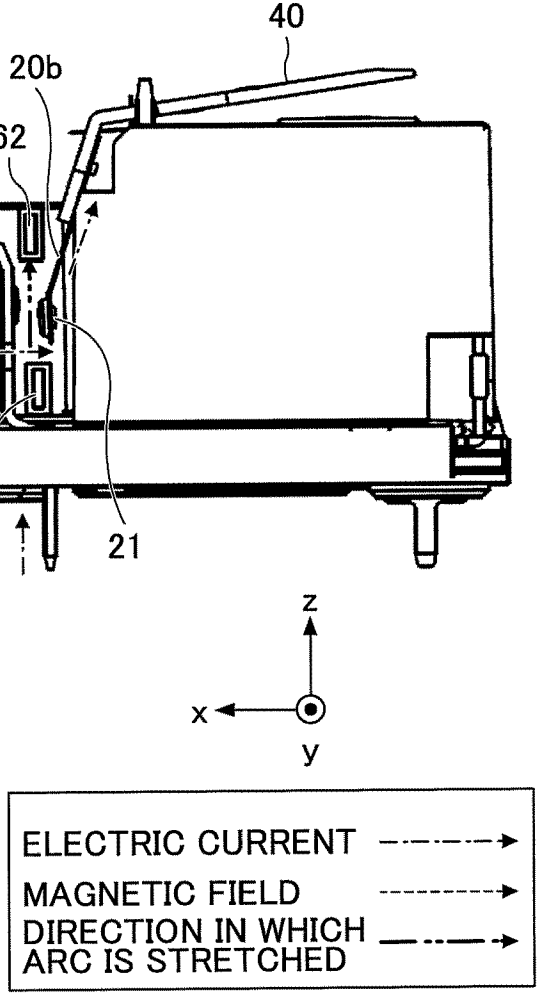

In a case where an electric current flows in a direction opposite the direction in FIGS. 8 through 9C, i.e., from the fixed contact part 10*b* to the fixed contact part 10*a*, the electric current flows as indicated by dashed-dotted arrows in FIGS. 11 through 12C. As indicated by dotted arrows, the magnetic field of the permanent magnet 50 is oriented substantially in −y direction at the position near the fixed contacts 11 and the movable contacts 21. FIG. 11 is a perspective view, FIG. 12A is a left-side view, FIG. 12B is a front view, and FIG. 12C is a right-side view of the relay.

Figure 13B:
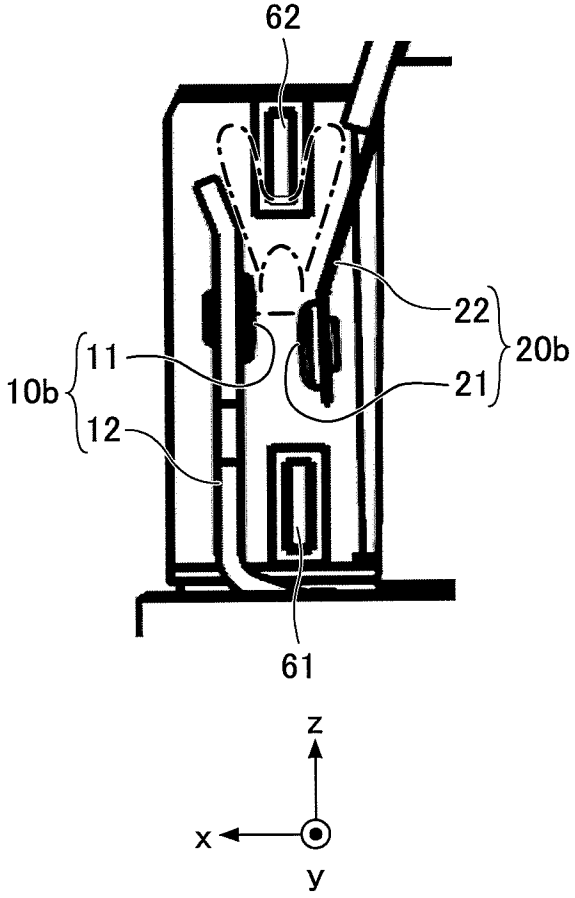
FIGS. 13A and 13B are drawings used to describe a mechanism for extinguishing an arc.
Figure 13A:
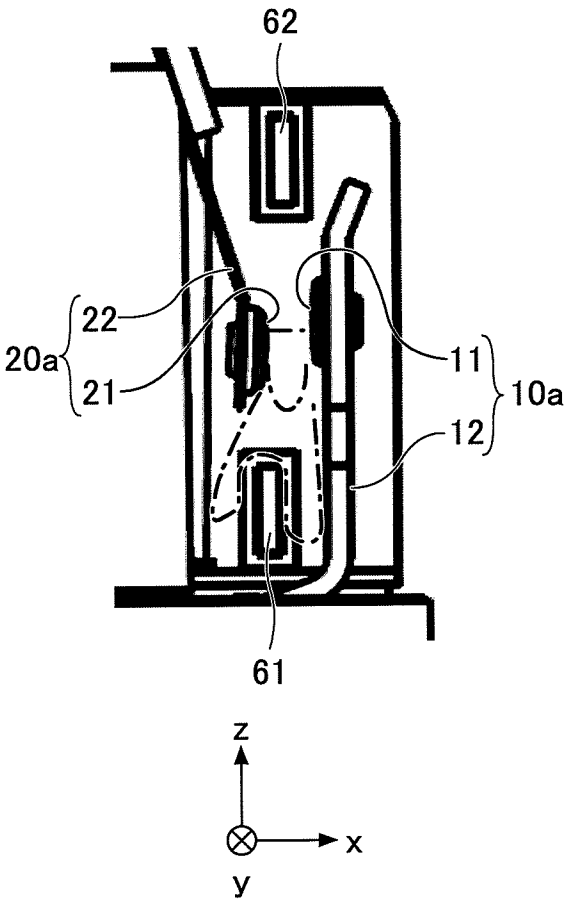

In this case, as illustrated in FIG. 12A, the electric current flows through the first contact pair in a direction from the movable contact 21 toward the fixed contact 11 as indicated by a dashed dotted arrow. Accordingly, an arc is stretched in −z direction. As illustrated in FIG. 13A, the stretched arc contacts the first arc extinguishing plate 61 disposed away from the fixed contact 11 and the movable contact 21 in −z direction, heat is removed from the arc by the first arc extinguishing plate 61, and the arc is quickly extinguished.

Also, as illustrated in FIG. 12C, the electric current flows through the second contact pair in a direction from the fixed contact 11 toward the movable contact 21 indicated by a dashed dotted arrow. Accordingly, an arc is stretched in the +z direction. As illustrated in FIG. 13B, the stretched arc contacts the second arc extinguishing plate 62 disposed away from the fixed contact 11 and the movable contact 21 in the +z direction, heat is removed from the arc by the second arc extinguishing plate 62, and the arc is quickly extinguished.

Thus, in the case where the electric current flows from the fixed contact part 10*b* to the fixed contact part 10*a*, an arc generated in the first contact pair and stretched by the permanent magnet 50 contacts and is extinguished by the first arc extinguishing plate 61, and an arc generated in the second contact pair and stretched by the permanent magnet 50 contacts and is extinguished by the second arc extinguishing plate 62.

As described above, the relay of the first embodiment can quickly extinguish an arc regardless of the direction in which an electric current flows.

Figure 14:
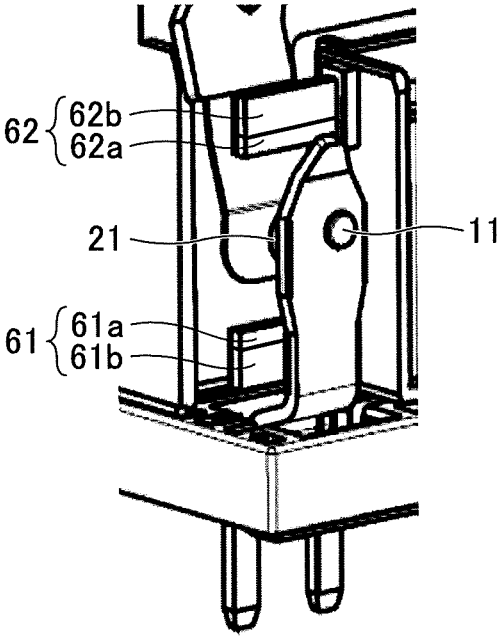
FIG. 14 is a drawing illustrating an electromagnetic relay according to a first variation of the first embodiment.

In the relay of the first embodiment, as illustrated in FIG. 14, each of the first arc extinguishing plate 61 and the second arc extinguishing plate 62 may be formed by two different types of materials. The first arc extinguishing plate 61 may be formed by joining a first part 61*a* and a second part 61*b*. The first part 61*a* is formed of ceramic and has higher thermal resistance than the second part 61*b*. The second part

61*b* is formed of a metal such as copper or aluminum and has higher thermal conductivity than the first part 61*a*. The first part 61*a* and the second part 61*b* are arranged such that the first part 61*a* faces the fixed contact 11 and the movable contact 21. Similarly, the second arc extinguishing plate 62 may be formed by joining a first part 62*a* formed of ceramic and a second part 62*b* formed of metal. The first part 62*a* and the second part 62*b* are arranged such that the first part 62*a* faces the fixed contact 11 and the movable contact 21. The first parts 61*a* and 62*a* contacting the arc first have higher thermal resistance and therefore are less likely to be damaged by the arc, and the second parts 61*a* and 62*b* having higher thermal conductivity can improve heat radiation. Accordingly, forming each of the first arc extinguishing plate 61 and the second arc extinguishing plate 62 with two different materials makes it possible to implement a highly-reliable relay.

Figure 15:
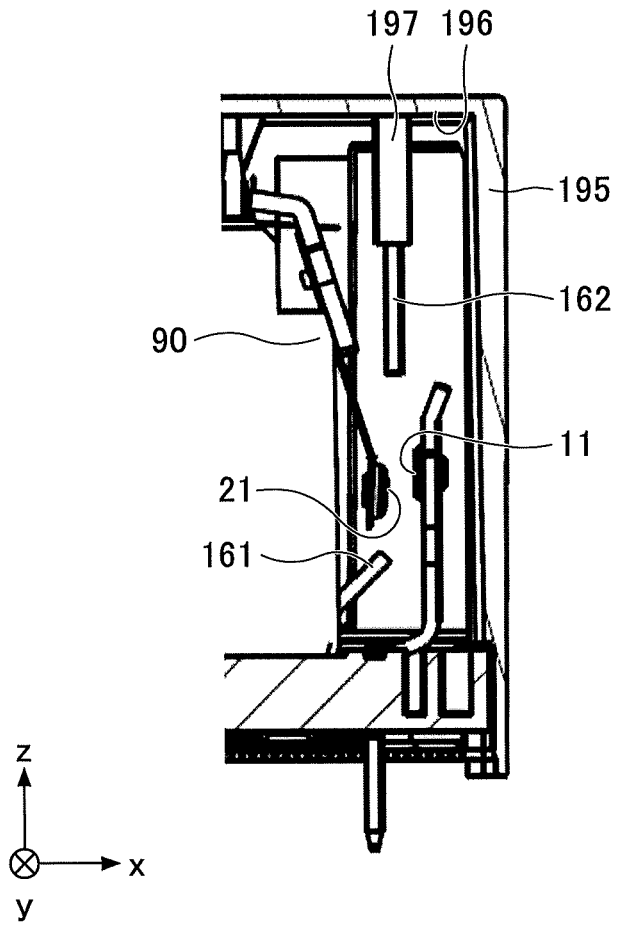
FIG. 15 is a drawing illustrating an electromagnetic relay according to a second variation of the first embodiment.
Figure 16:
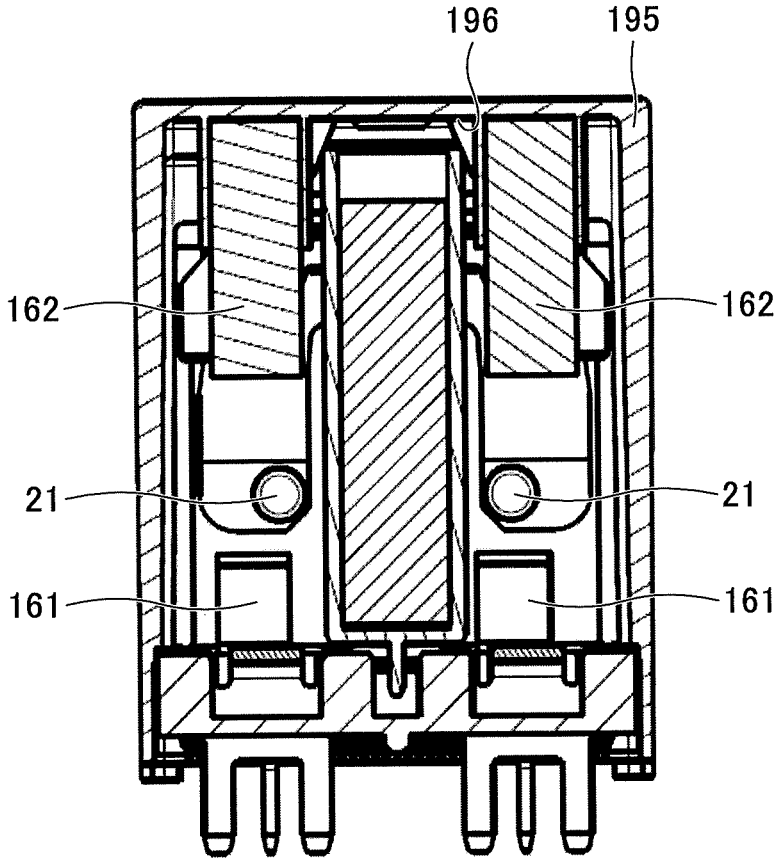
FIG. 16 is a cross-sectional view of the electromagnetic relay according to the second variation of the first embodiment.

When an arc stretched in an M-shape is further stretched and wraps around an arc extinguishing plate, the stretched arc may short-circuit behind the arc extinguishing plate and become short again. As a result, it becomes difficult to extinguish the arc. To prevent a stretched arc from wrapping around the first arc extinguishing plate 61 or the second arc extinguishing plate 62 and short-circuiting behind the arc extinguishing plate as illustrated in FIGS. 15 and 16, the relay may include a first arc extinguishing plate 161 that is attached to the insulation case 90 such that no gap is formed in −z direction, and a second arc extinguishing plate 162 that is attached to a ceiling 196 of a cover 195 such that no gap is formed in +z direction.

Figure 17:
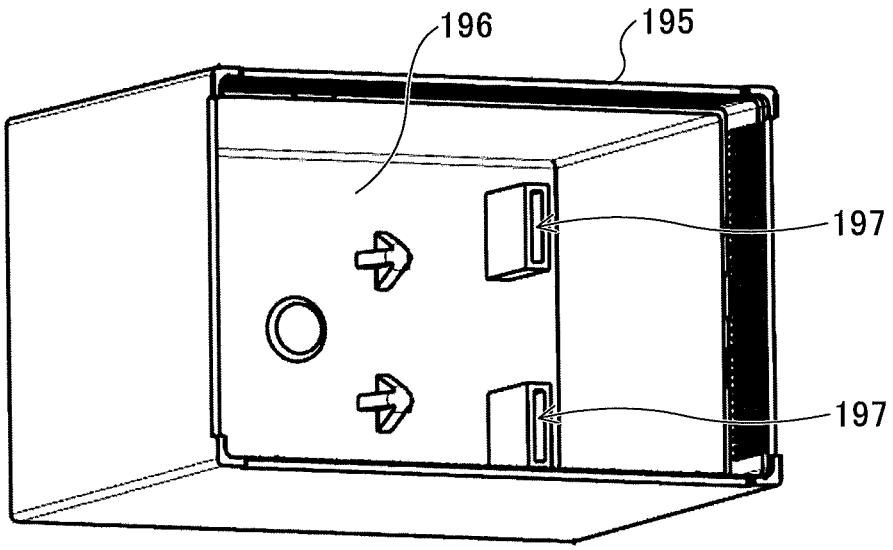
FIG. 17 is a drawing illustrating a cover of the electromagnetic relay according to the second variation of the first embodiment.

As illustrated in FIG. 17, a press-in socket 197 is provided on the ceiling 196. The second arc extinguishing plate 162 is attached to the ceiling 196 by pressing the second arc extinguishing plate 162 into the socket 197. The first arc extinguishing plate 161 is attached such that the first arc extinguishing plate 161 is inclined with respect to a surface of the insulation case 90 in order to prevent the first arc extinguishing plate 161 from interfering with the bent bottom part of the fixed terminal 12. However, as long as no gap is formed in −z direction, the first arc extinguishing plate 161 may be attached to the insulation case 90 in any other manner.

Second Embodiment

Figure 18:
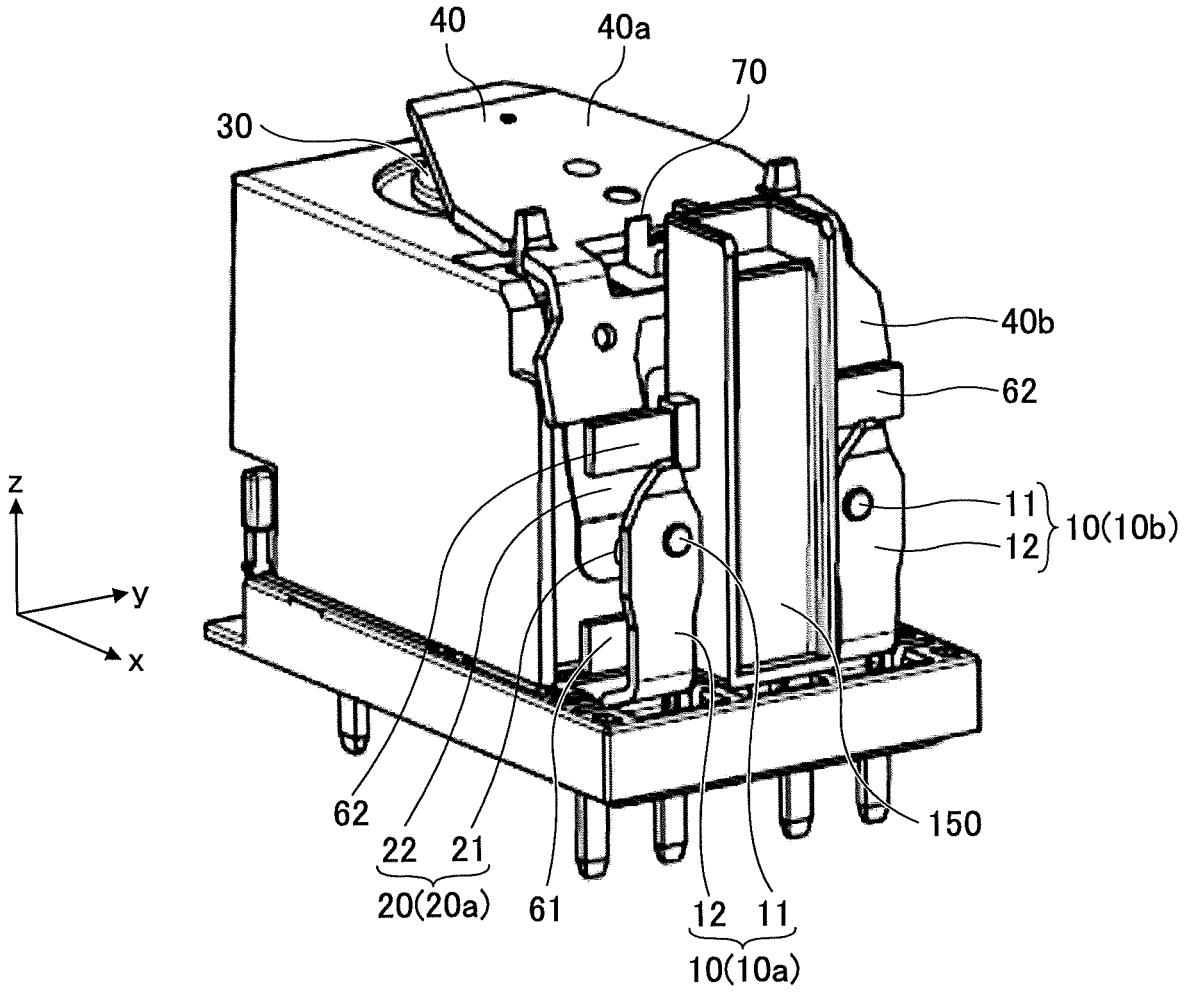
FIG. 18 is a perspective view of an electromagnetic relay according to a second embodiment.
Figure 19:
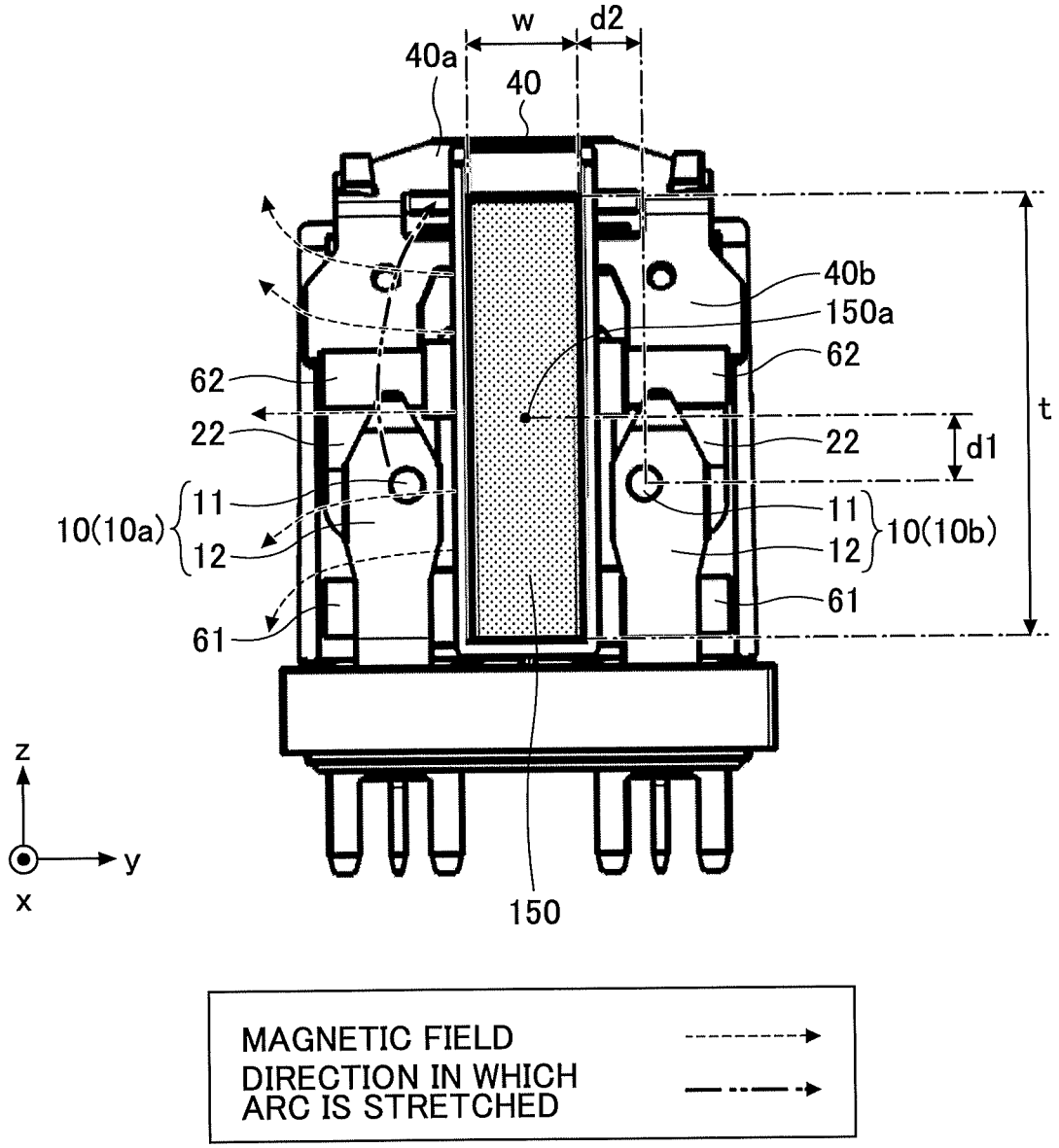
FIG. 19 is a front view of the electromagnetic relay according to the second embodiment.
Figure 20:
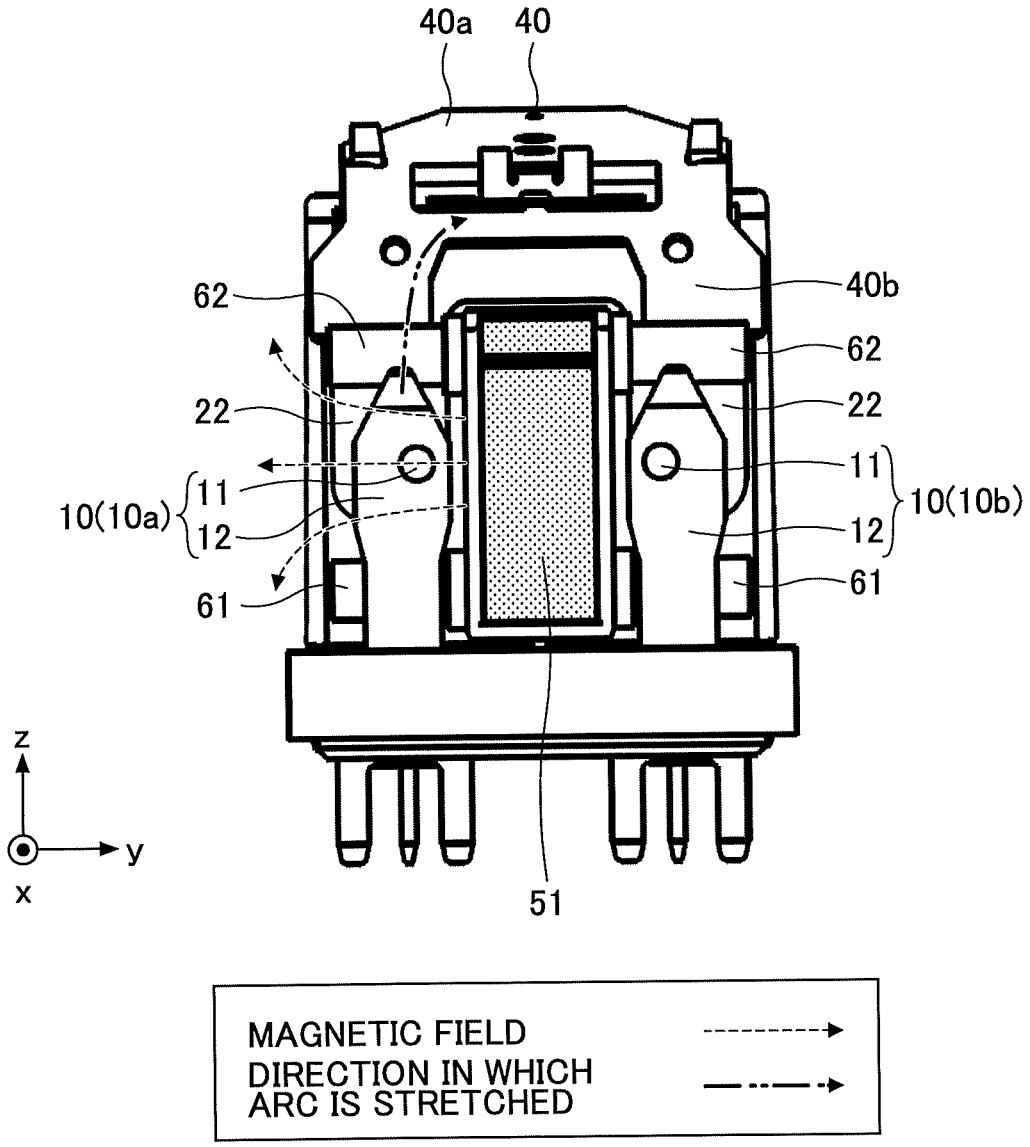
FIG. 20 is a front view of an electromagnetic relay of a comparative example.

Next, a second embodiment is described. As illustrated in FIGS. 18 and 19, a relay of the second embodiment includes a permanent magnet 150 that is long in z direction. For example, as illustrated in FIG. 20, if a permanent magnet 51 that is short in the z direction is used, a generated arc is stretched toward the permanent magnet 51 as indicated by a dashed double-dotted arrow and may damage the movable spring 22 and the armature 40 near the permanent magnet 51.

In the second embodiment, the permanent magnet 150 that is long in z direction is used, and the fixed contact 11 and the movable contact 21 are disposed in positions that are shifted in −z direction from the center of the permanent magnet 150 in the longitudinal direction. With this configuration, as indicated by a dashed double-dotted arrow in FIG. 19, a generated arc is first stretched in a direction away from the permanent magnet 150 and contacts the second arc extinguishing plate 62 at a position away from the permanent magnet 150. Thus, it is possible to extinguish the arc before the arc contacts the side wall 91 and the spring 70. For this reason, the fixed contact 11 and the movable contact 21 are disposed in positions that are shifted from a center 150*a* of the permanent magnet 150 in a direction that is opposite the direction in which an arc generated between the fixed contact 11 and the movable contact 21 is stretched.

In the relay of the second embodiment, the direction in which an electric current flows through the first contact pair is opposite the direction in which the electric current flows through the second contact pair. Accordingly, an arc generated on the first contact pair and an arc generated on the second contact pair are stretched by the permanent magnet 150 in opposite directions. When an arc is stretched long toward the upper side of the figure having a larger space and is preferentially extinguished, an arc generated between another contact pair and stretched toward the lower side of the figure is naturally extinguished because the arcs are arranged in series in an electric circuit. This also applies to a case where the electric current flows in the opposite direction. As indicated in FIG. 19, the magnetic field of the permanent magnet 150 is distributed such that the magnetic field spreads wider as the distance from the center in the vertical direction increases. Because the fixed contact 11 and the movable contact 21 are positioned lower than the center of the permanent magnet 150 in the vertical direction, an arc is stretched such that the arc first extends away from the permanent magnet 150 and then returns toward the permanent magnet 150 in upper positions.

In other words, the fixed contact 11 and the movable contact 21 are positioned in an area that is lower than the center of the permanent magnet 150, and the magnetic flux is generated in a downward direction rather than in a horizontal direction in such area. Because an arc extends in a direction orthogonal to the magnetic flux, the arc is stretched at the position of the contacts by the downward magnetic flux in a direction away from the permanent magnet 150. This in turn makes it possible to prevent the arc from being stretched inward in an upper area in FIG. 19.

For example, a distance d1 between the center 150*a* of the permanent magnet 150 and the center of the fixed contact 11 is about 4 mm. In this case, a length t of the permanent magnet 150 is about 22 mm, a width w of the permanent magnet 150 is about 5.8 mm, and a distance d2 between the permanent magnet 150 and the center of the fixed contact 11 is about 3.4 mm.

Figure 21:
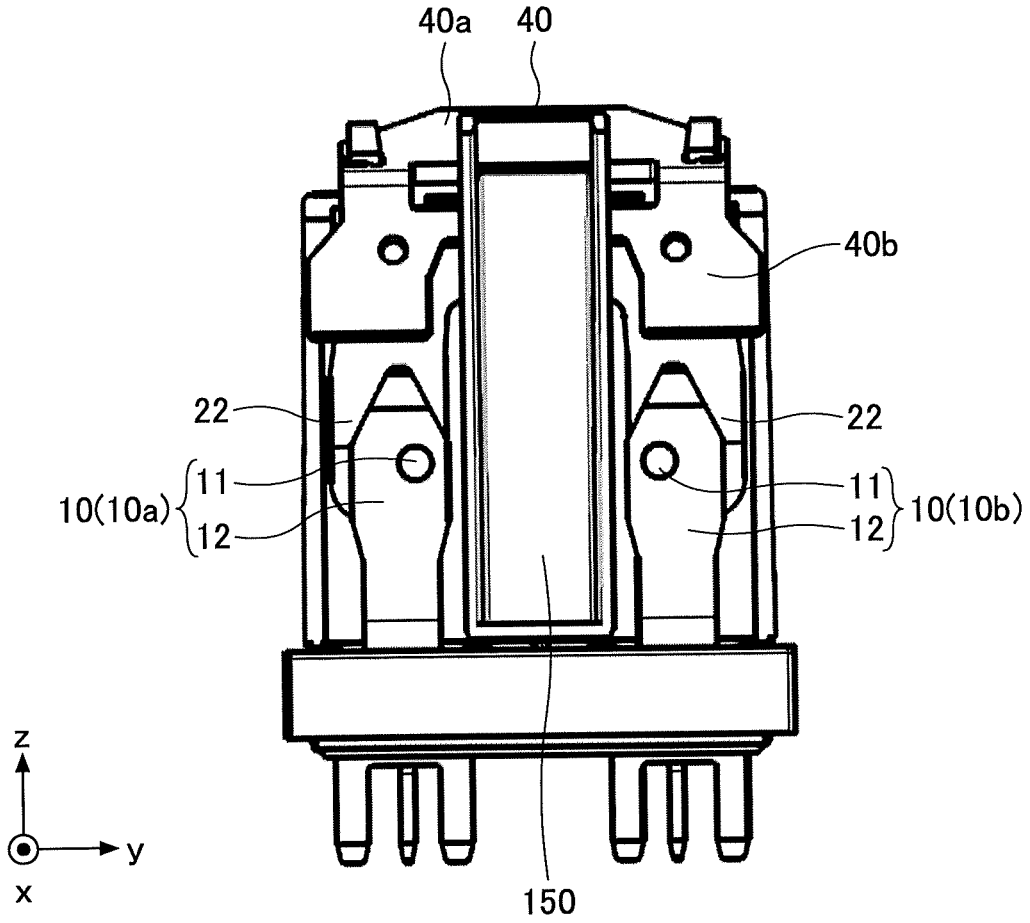
FIG. 21 is a front view of an electromagnetic relay according to a variation of the second embodiment.

As illustrated in FIG. 21, the relay of the second embodiment may be configured to not include the arc extinguishing plates. Even with this configuration, because the fixed contact 11 and the movable contact 21 are disposed in positions shifted from the center of the permanent magnet 150 in the longitudinal direction, an arc can be stretched longer and damage caused by the arc on the side wall 91 and the spring 70 can be reduced. However, it is preferable to include the arc extinguishing plates so that an arc can be more quickly extinguished.

Other components and configurations of the relay of the second embodiment are substantially the same as those described in the first embodiment.

Third Embodiment

Next, a third embodiment is described. In the embodiment, an armature is formed of a magnetic material with high permeability and has a certain thickness to provide strength.

Figure 22:
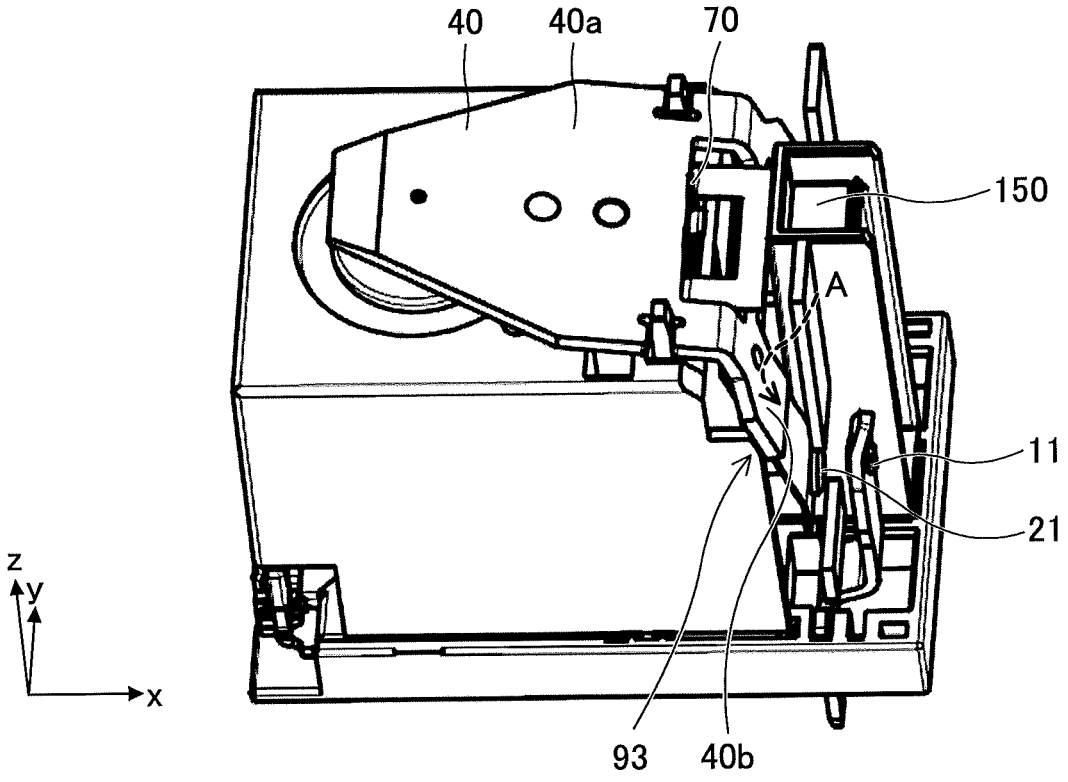
FIG. 22 is a perspective view of an electromagnetic relay of a comparative example.

As indicated by an arrow A in FIG. 22, the magnetic flux from the permanent magnet 150 passes through the second side 40*b* of the armature 40. Therefore, the magnetic field is weakened in an area higher than the fixed contact 11 and the movable contact 21 in +z direction, and the effect of the magnetic field to stretch the arc may be reduced.

When the movable contact 21 moves away from the fixed contact 11, the second side 40*b* of the armature 40 contacts a backstop 93 formed on the insulation case 90 while the restoring force of the spring 70 is maintained to position the movable contact 21 attached to the movable spring 22 and to suppress the return bounce of the movable contact 21.

The second side 40*b* of the armature 40 that is thicker than the movable spring 22 and has a greater thermal capacity than the movable spring 22 is configured to contact the backstop 93, so that the backstop 93 is not affected by heat generated by an arc or when electricity flows between the contacts.

Figure 23:
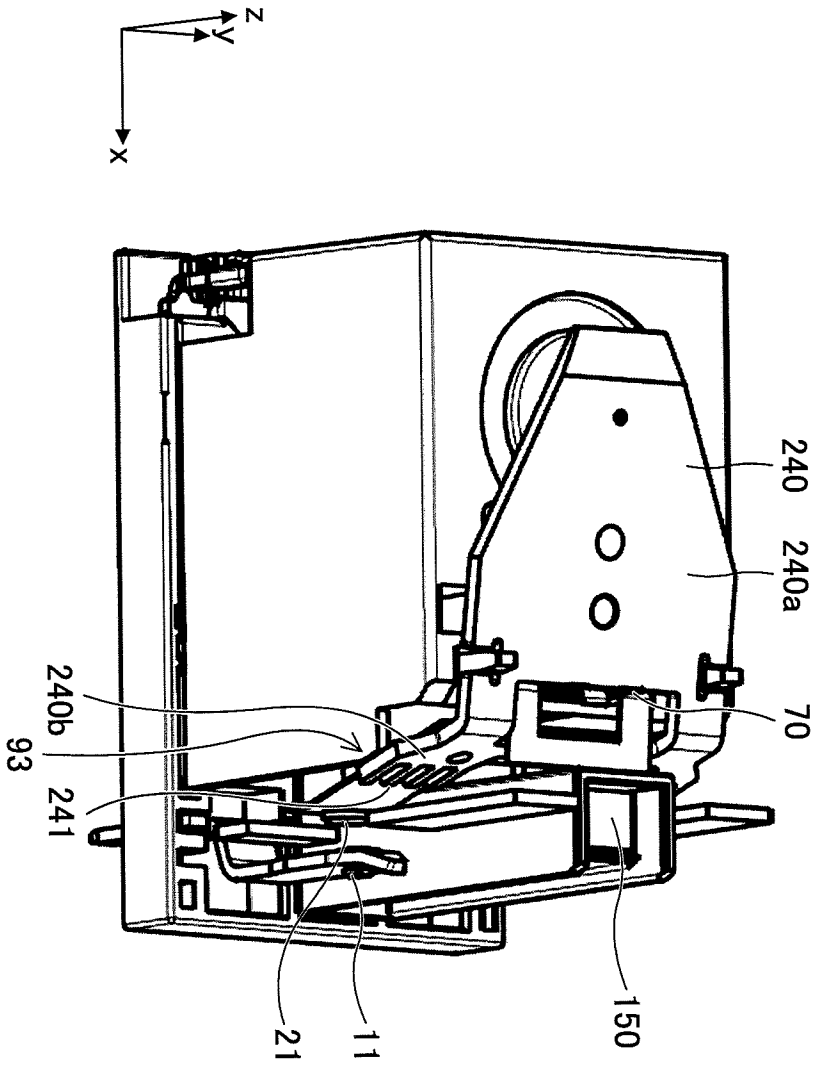
FIG. 23 is a perspective view of an electromagnetic relay according to a third embodiment.
Figure 24:
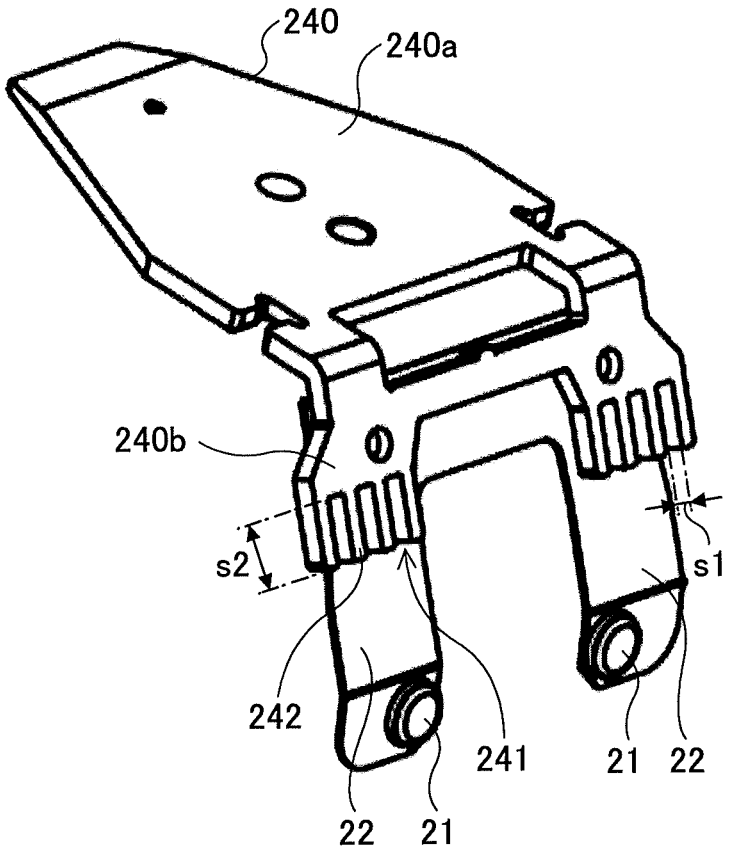
FIG. 24 is a drawing illustrating an armature of the electromagnetic relay according to the third embodiment.

As illustrated in FIGS. 23 and 24, a relay of the third embodiment includes an armature 240 that is divided at the bend into a first side 240*a* to be brought into contact with the electromagnet 30 and a second side 240*b* connected to the movable contact part 20. Multiple slits 241 are formed in the second side 240*b* such that the second side 240*b* is shaped like a comb having multiple teeth 242. The portion of the second side 240*b* where the teeth 242 are formed exhibits high magnetic reluctance, and therefore the magnetic flux entering the second side 240*b* is reduced. This configuration makes it possible to prevent the magnetic field of the permanent magnet 150 from being weakened in an area higher than the fixed contact 11 and the movable contact 21 in +z direction, and to prevent the reduction in the effect of the magnetic field to stretch the arc.

Further, the tooth 242 contact the backstop 93 to position the movable contact 21 attached to the movable spring 22 and to suppress the return bounce of the movable contact 21.

In the third embodiment, a width s1 of each slit 241 is about 1 mm, and a length s2 of the slit 241 is about 3 mm.

The second side 240*b* of the armature 240 contacts the backstop 93 to stop the backward movement. In a state where the armature 240 is in the home position and in contact with the backstop 93, the spring 70 is still tensioned and prevents the bounce of the movable contact 21 returning to the home position. When the backstop 93 is not provided, the position of the returned armature 240 in the returned state becomes unstable, and the operating voltage to bring the movable contact 21 into contact with the fixed contact 11 becomes unstable.

Figure 25:
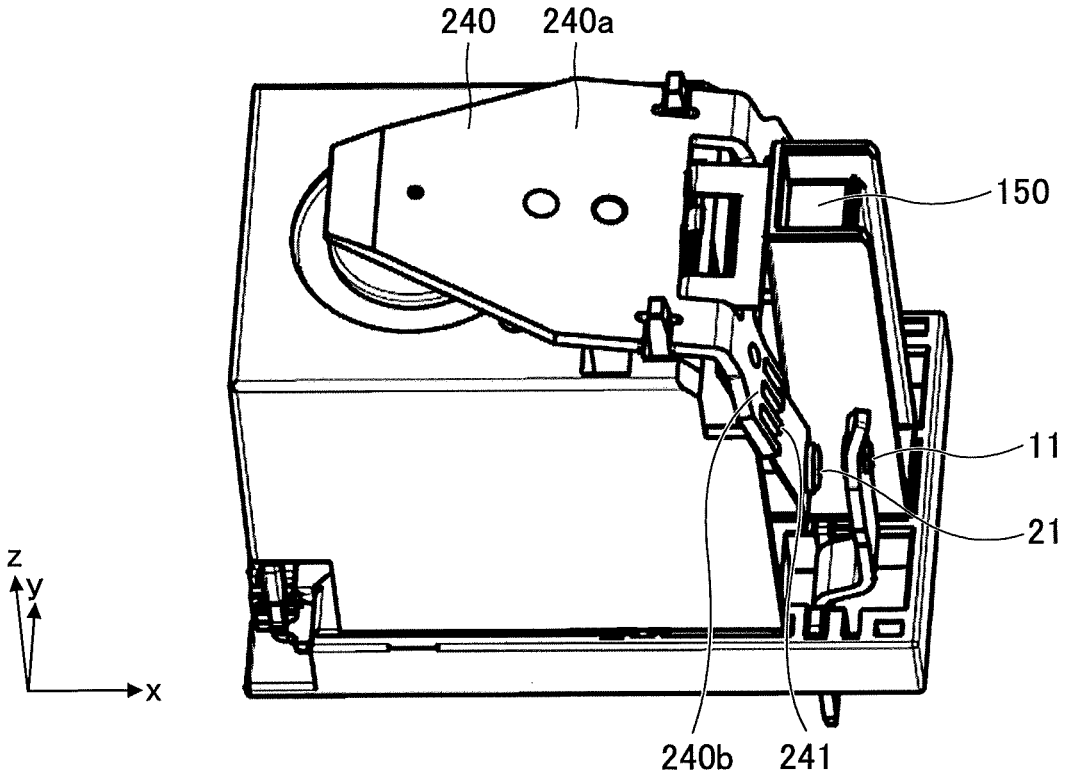
FIG. 25 is a front view of an electromagnetic relay according to a variation of the third embodiment.

As illustrated in FIG. 25, the relay of the third embodiment may be configured to not include the arc extinguishing plates. Even with this configuration, it is possible to stretch an arc. However, it is preferable to include the arc extinguishing plates so that an arc can be more quickly extinguished.

Other components and configurations of the relay of the third embodiment are substantially the same as those described in the first or second embodiment.

An aspect of this disclosure makes it possible to provide a relay that can quickly extinguish an arc even when an electric current flows in both directions, and makes it possible to improve the reliability of the relay.

Relays according to embodiments of the present invention are described above. However, the present invention is not limited to the specifically disclosed embodiments, and variations and modifications may be made without departing from the scope of the present invention.

What is claimed is:

1. An electromagnetic relay, comprising:

a first contact pair including a first fixed contact part and a first movable contact part, and a second contact pair including a second fixed contact part and a second movable contact part, each fixed contact part including a fixed terminal and a fixed contact connected to the fixed terminal, and each movable contact part including a movable spring and a movable contact connected to the movable spring;

an armature to which the movable contact part is connected;

an electromagnet configured to move the armature;

a magnet configured to stretch an arc generated between the fixed contact and the movable contact; and a first arc extinguishing plate and a second arc extinguishing plate configured to extinguish the stretched arc, wherein the first arc extinguishing plate and the second arc extinguishing plate are arranged at a distance from each other in a first direction that is parallel to a direction in which an electric current flows through the fixed terminal;

each fixed contact and each movable contact are disposed between the first arc extinguishing plate and the second arc extinguishing plate in the first direction;

the first arc extinguishing plate and the second arc extinguishing plate are disposed between the fixed terminal and the movable spring in a second direction that is orthogonal to the first direction and in which the fixed contact and the movable contact face each other; and the magnet is disposed between the first contact pair and the second contact pair.

2. The electromagnetic relay as claimed in claim 1, wherein a line connecting the first arc extinguishing plate and the second arc extinguishing plate is substantially orthogonal to a direction of a magnetic field of the magnet.

3. The electromagnetic relay as claimed in claim 1, wherein a direction in which the electric current flows through the first contact pair is opposite a direction in which the electric current flows through the second contact pair.

4. The electromagnetic relay as claimed in claim 1, wherein the fixed contact and the movable contact are disposed in positions that are shifted from a center of the magnet in a direction that is opposite a direction in which the arc generated between the fixed contact and the movable contact is stretched.

5. The electromagnetic relay as claimed in claim 1, wherein an end portion of the armature to which the movable contact part is connected has a comb shape.

* * * * *